US011253063B2

(12) United States Patent
Chen

(10) Patent No.: US 11,253,063 B2
(45) Date of Patent: Feb. 22, 2022

(54) BLIND CORNER PULLOUT AND METHOD OF USE

(71) Applicant: Hardware Resources, Inc., Bossier City, LA (US)

(72) Inventor: Alan Chen, Lewisville, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 16/946,827

(22) Filed: Jul. 8, 2020

(65) Prior Publication Data

US 2022/0007832 A1 Jan. 13, 2022

(51) Int. Cl.
*A47B 81/00* (2006.01)
*A47B 53/02* (2006.01)
*A47B 88/437* (2017.01)

(52) U.S. Cl.
CPC ..... *A47B 81/002* (2013.01); *A47B 53/02* (2013.01); *A47B 88/437* (2017.01)

(58) Field of Classification Search
CPC ..... A47B 46/00; A47B 53/02; A47B 77/00; A47B 77/02; A47B 77/10; A47B 81/002; A47B 88/40; A47B 88/437; A47B 88/0466; A47B 88/497; A47B 88/70; A47B 88/02; A47B 88/45
See application file for complete search history.

(56) References Cited

U.S. PATENT DOCUMENTS

| | | | | |
|---|---|---|---|---|
| 3,863,279 | A | 2/1975 | Stalder | |
| 4,738,495 | A * | 4/1988 | Mitts | A47B 49/006 108/140 |
| 5,752,756 | A | 5/1998 | Compagnucci | |
| 5,941,620 | A | 8/1999 | Weber | |
| 8,083,303 | B2 | 12/2011 | Compagnucci | |
| 9,101,215 | B2 | 8/2015 | Kreyenkamp et al. | |
| 9,103,362 | B2 | 8/2015 | Baro et al. | |
| 9,462,884 | B2 | 10/2016 | Hunter | |
| 10,024,593 | B2 | 7/2018 | Holm | |
| 2006/0181183 | A1 | 8/2006 | Galloway | |

FOREIGN PATENT DOCUMENTS

| | | | |
|---|---|---|---|
| CN | 203873299 | U | 10/2014 |
| DE | 4323407 | A1 | 12/1996 |
| EP | 0441919 | B1 | 3/1993 |

(Continued)

OTHER PUBLICATIONS

Wire Bottom Blind Corner Optimizer Rev-A-Shelf https://rev-a-shelf.com/catalogsearch/result/?q=blind+corner+pullout (last accessed Mar. 15, 2020).

(Continued)

*Primary Examiner* — Andrew M Roersma

(74) *Attorney, Agent, or Firm* — Schultz & Associates, P.C.

(57) ABSTRACT

A basket pullout system for a blind corner cabinet with an orientation bracket and stabilizer for installation of a blind corner pullout with adjustable shelves. The orientation bracket allows for easy installation of a base assembly irrelevant of which side the door opens or whether the cabinet has a face frame. The vertical stanchion assembly also allows for easy adjustment of slide positions to transition between a cabinet with the door on the right to the door on the left, and vice versa.

16 Claims, 21 Drawing Sheets

(56) References Cited

FOREIGN PATENT DOCUMENTS

| | | | | | |
|---|---|---|---|---|---|
| EP | 1479315 | A1 | | 11/2004 | |
| EP | 1591039 | B1 | | 6/2010 | |
| EP | 2774508 | B1 | | 11/2015 | |
| JP | 04325108 | A | | 11/1992 | |
| JP | 05146325 | A | | 6/1993 | |
| JP | 05253025 | A | | 10/1993 | |
| JP | 2002078550 | A | | 3/2002 | |
| KR | 1020040038084 | A | * | 5/2004 | |
| WO | 033022100 | A1 | | 3/2003 | |
| WO | WO-2007034529 | A1 | * | 3/2007 | ..... A47B 81/002 |
| WO | WO-2020079643 | A1 | * | 4/2020 | ..... A47B 81/002 |

OTHER PUBLICATIONS

Slide Out Base Blind Corner Unit Knape & Vogt https://www.homedepot.com/p/Knape-Vogt-19-75-in-x-26-19-in-x-22-19-in-Left-Hand-Slide-Out-Base-Blind-Corner-Unit-BBCS-L-15-FN/203303399 (last accessed Mar. 15, 2020).

Three-Tier Blind Corner Optimizer TJ Hardware https://tjhardware.com/product/pullout-soft-close-wire-solid-bottom-pull-slidepull-blind-corner-accessories/ (last accessed Mar. 15, 2020).

Blind Corner Universal Metal Corner Pullout His Warehouse https://www.hiswarehouse.net/store/p1498/Blind_Corner_Universal_Metal_Corner_Pullout_26%22W_x_20-1%2F2%22D_x_24%22H.html (last accessed Mar. 15, 2020).

Blind Corner Pullout QuikDrawers by The Cabinet Guy https://quikdrawers.com/blind-corner-pullout (last accessed Mar. 15, 2020).

* cited by examiner

BLIND CORNER PULLOUT AND METHOD OF USE

FIELD OF THE INVENTION

The present invention relates to pullout mechanisms for a "blind corner" kitchen cabinet.

BACKGROUND OF THE INVENTION

Modern kitchens place a premium on storage space. Storage space is often not effectively utilized in "blind corner" cabinets because the portion of the cabinet behind the cabinet wall adjacent the door is inaccessible.

Pullout mechanisms for blind corner cabinets are generally difficult to install. They are heavy and require a great deal of space and positioning when installed due to the dead space behind the cabinet wall adjacent the cabinet door. As a result, precision installation of prior art mechanisms is time consuming and expensive and error prone.

Blind corner kitchen cabinets present further problems with respect to orientation. Blind corner cabinets may be either "right-hand" or "left-hand" oriented dependent on the relative positions of the cabinet door. Furthermore, blind corner cabinets also present issues because they may either "framed" or "unframed".

The different variations and orientations of kitchen cabinets require prior art pullout mechanisms to be made in dedicated and specific configurations in order to accommodate the different variations of cabinets. Hence, the prior art lacks a fully adaptable design.

The prior art has attempted many solutions to the problems presented by blind corner cabinets. But none of them is optimal.

For example, U.S. Pat. No. 3,863,279 to Stadler discloses a right angled corner cabinet draw and push mechanism which positions a drawer behind the dead space in the cabinet. However, the mechanism is limited to right-hand oriented cabinets. Further, due to the complexity of the draw and push mechanism, precise measurement and placement within the cabinet is required, for installation thereby making installation complicated.

U.S. Pat. No. 9,462,884 to Hunter discloses a system of drawers for use in a corner cabinet. A pullout system is disclosed which comprises separate sets of heavy duty runner systems at opposed 90° angles. The system allows the drawers to move laterally and longitudinally within the cabinet carcass. However, lateral movement of one drawer is dependent on the lateral movement of the other drawer. More importantly, the runner systems are dedicated to either right-hand or left-hand oriented cabinet frames and are not interchangeable.

In a similar way, U.S. Publication No. 2006/0181183 to Galloway discloses a multi-directional drawer system designed to be fitted in a corner under a cabinet to maximize storage space. A multi-direction track is provided which generally includes a platform and a tray. However, the system requires that the tracks be coupled to each other via the trays and the platform so that the drawer has a continuous track along which to move. The tray, the tracks and the platform each must be precisely aligned in either a right-hand or left-hand fashion which limits the mechanism to use in one orientation and requires complicated installation to function properly.

SUMMARY OF THE INVENTION

The pullout mechanism disclosed includes a novel bracket and stabilizer which allow for installation without precise or complicated installation. The mechanism can be used with both right-hand and left-hand oriented blind corner cabinets by merely changing the positions of the bracket and stabilizes. Further, the bracket is adapted to allow for installation of the pullout mechanism in cabinets with or without a face frame.

The configuration of the bracket provides proper spacing from the door side wall to the face frame and secure mounting for the pullout mechanism. The configuration of the bracket also provides proper positioning of the pullout mechanism for both stowed and extended positions.

The pullout mechanism includes a right-hand and left-hand vertical support subassembly. The position of the vertical support subassemblies is easily changed to adapt to either right-hand or left-hand installation.

The vertical support sub-assembly provides for adjustable mounting of primary and secondary drawers. The drawers are reversable between position on the vertical support sub-assembly in order to accommodate right-hand or left-hand oriented cabinets.

BRIEF DESCRIPTION OF THE DRAWINGS

In the detailed description of the preferred embodiments presented below, reference is made to the accompanying drawings.

DETAILED DESCRIPTION OF THE INVENTION

In the description that follows, like parts are marked throughout the specification and figures with the same numerals, respectively. The figures are not necessarily drawn to scale and may be shown in exaggerated or generalized form in the interest of clarity and conciseness.

Figure 1:
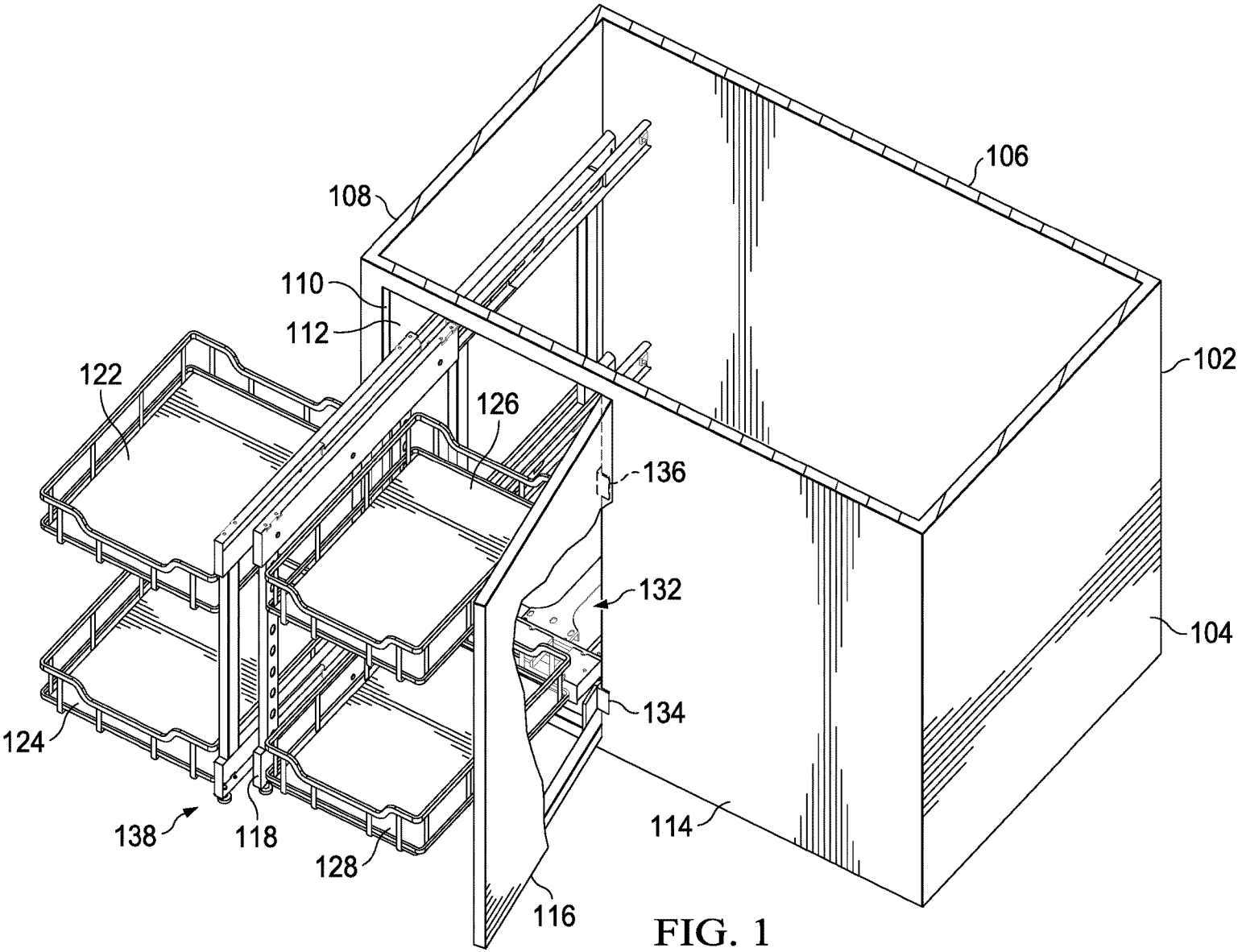
FIG. 1 is a cutaway isometric view of a blind cabinet carcass with left side door opening.

Referring to FIG. 1, left oriented cabinet carcass 102 is shown. Left oriented cabinet carcass 102 includes blind side wall 104 and door side wall 108. Back wall 106 extends between door side wall 108 and blind side wall 104. Front wall 114 is located adjacent blind side wall 104. Face frame 110 is adjacent to door side wall 108. Face frame 110 includes door opening 112. Door 116 is attached to the right side of the face frame by way of hinge 134 and hinge 136.

Blind corner pullout 138 includes base assembly 132, vertical stanchion assembly 118, primary baskets 122 and 124, and secondary baskets 126 and 128. Base assembly 132 is attached the to the floor of the cabinet carcass. Primary baskets 122 and 124 and secondary baskets 126 and 128 are removably attached to vertical stanchion assembly 118.

Figure 2:
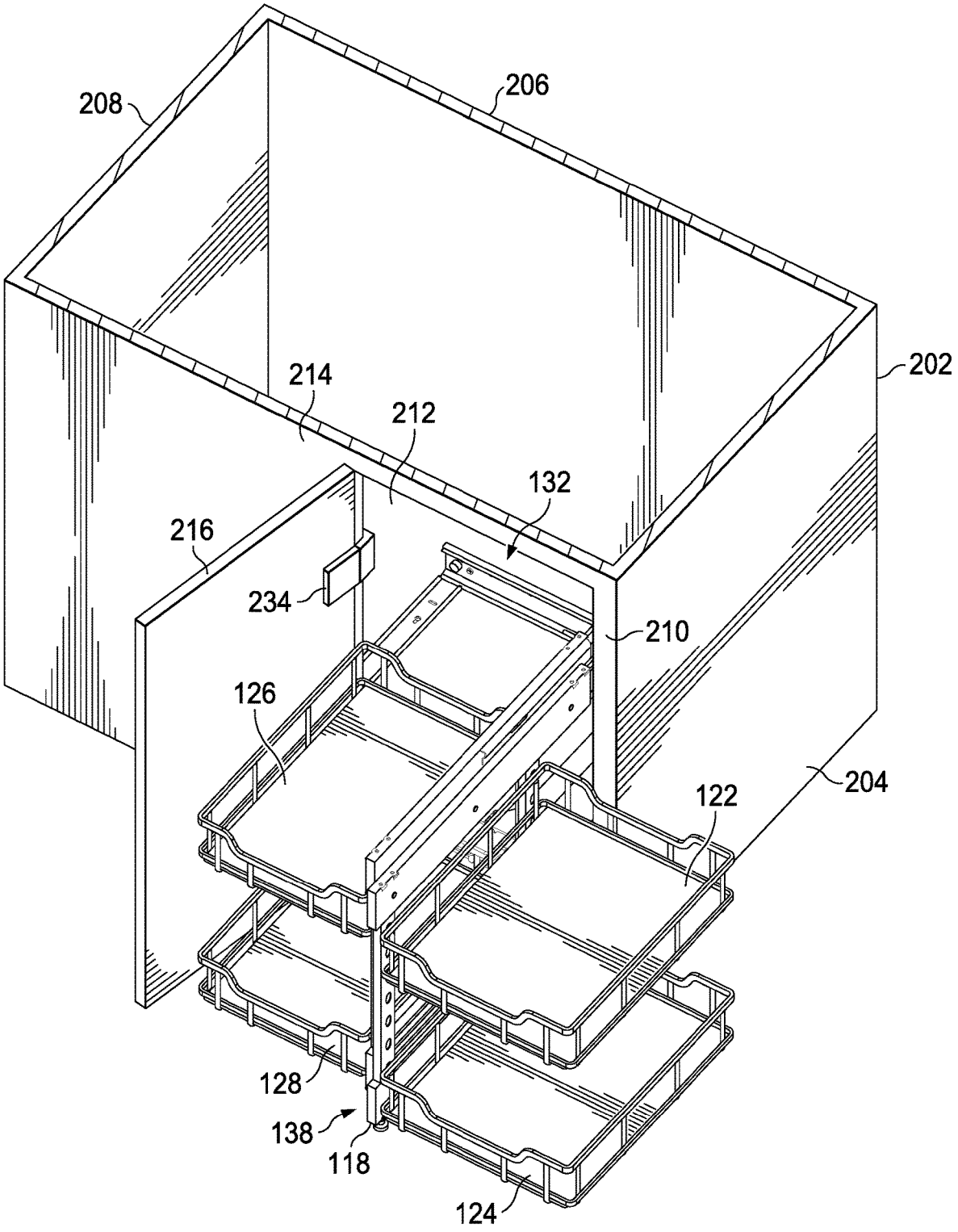
FIG. 2 is an isometric view of a blind cabinet carcass with right side door opening.

Referring to FIG. 2, right oriented cabinet carcass 202 is shown. Right oriented cabinet carcass 202 includes blind side wall 208 and door side wall 204. Back wall 206 extends between door side wall 204 and blind side wall 208. Front wall 214 is located adjacent blind side wall 208. Face frame 210 is adjacent to door side wall 204. Face frame 210 includes door opening 212. Door 216 is attached to the left side of the face frame by way of hinges such as hinge 234.

Base assembly 132 is attached the to the floor of the right cabinet carcass. Primary baskets 122 and 124 and secondary baskets 126 and 128 are removably attached to vertical stanchion assembly 118.

Figure 3:
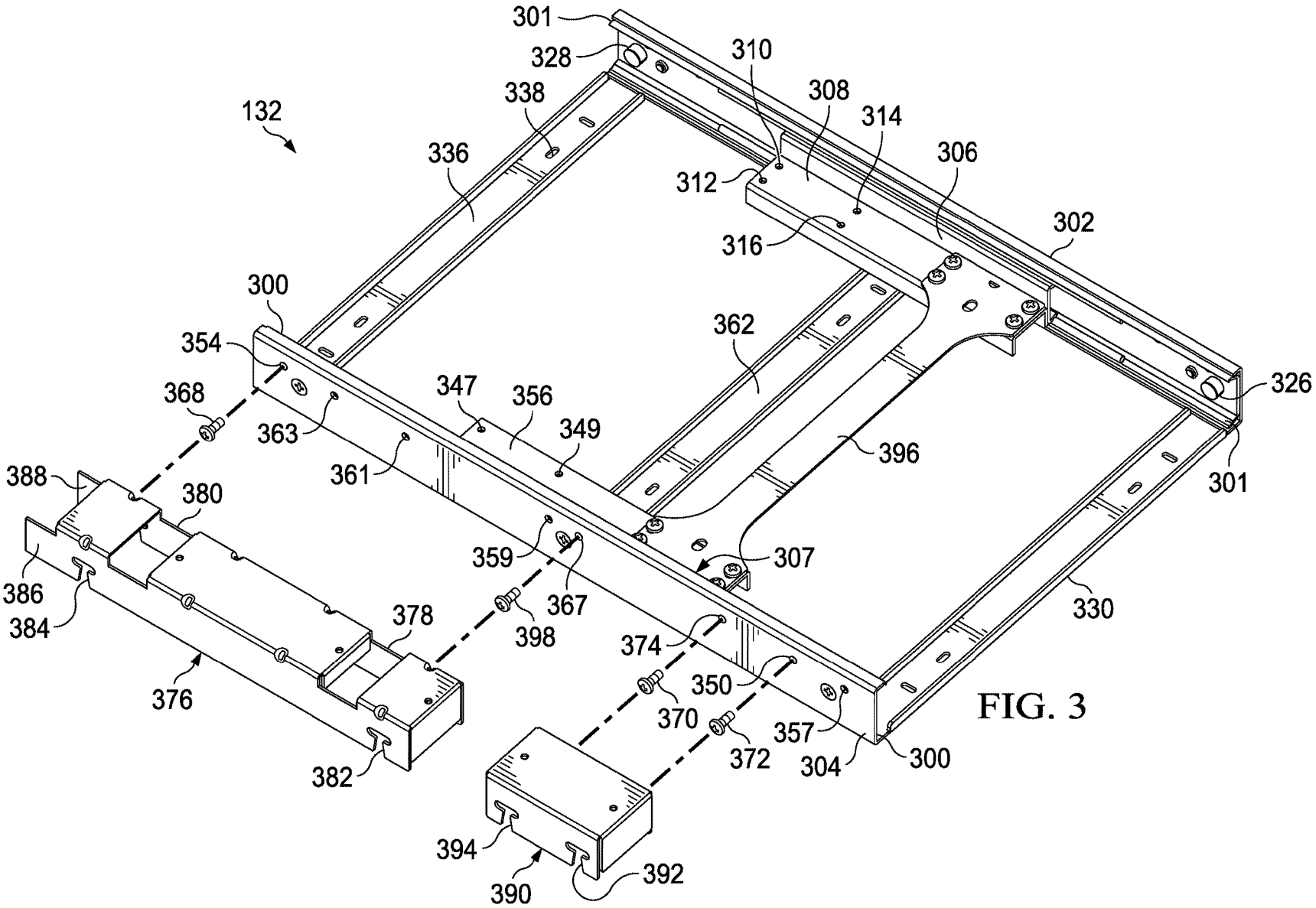
FIG. 3 is an exploded isometric view of a base assembly in left side face frame position.

FIG. 3 shows base assembly 132 arranged for installation in a left-hand oriented cabinet carcass including a face frame. Base assembly 132 includes rail 302. Rail 302 is connected to door opening crossbar 336. Door opening crossbar 336 is further connected to rail 304. Rail 304 is connected to blind side cross bar 330. Blind side cross bar 330 is connected to rail 302. Central crossbar 362 is connected to rail 302 and rail 304. Rail 302 and rail 304 are mirror images of each other. The rails are substantially parallel with each other and substantially perpendicular to the crossbars. The connections are preferably welded. In a preferred embodiment, the rails are between about 1¼" to about 2¾" in height.

Door opening crossbar 336, central crossbar 362 and blind side cross bar 330 include a plurality of holes 338 for securing the base assembly to the cabinet floor, as will be further described.

Rail 302 includes integrally formed bearing races 301 which form a track for slide 306. Rail 302 supports resilient bumpers 326 and 328 which bound the movement of the slide. Slide 306 is constrained to move within integrally formed bearing races 301.

Slide 306 includes flange 308. Flange 308 extends substantially perpendicularly from slide 306. Flange 308 includes vertical stanchion support holes 310, 312, 314, and 316.

Rail 304 includes integrally formed bearing races 300 which form a track for slide 307. Slide 307 is constrained to move within integrally formed bearing races 300. Bumpers (not shown) are provided on the interior of the rail, at each end, to bound the movement of slide 307.

Slide 307 includes flange 356. Flange 356 includes four vertical stanchion support holes 347, 349, and two which will be described later.

Cross brace 396 is connected to flange 308 and to flange 356 by metal screws or welding. Cross brace 396 is substantially perpendicular to both flange 308 and flange 356. The cross brace constrains the slides to move in unison in the bearing races.

Rail 304 further includes holes 354, 363, 361, 359, 367, 374, 350 and 357. Holes 354 and 363 are located adjacent door opening crossbar 336. Hole 361 is located between the door opening cross bar and the central cross bar. Holes 359 and 367 are located adjacent central crossbar 362. Hole 374 is located between the central cross bar and the blind side cross bar. Holes 350 and 357 are located adjacent blind side cross bar 330. Rail 302 has mirror image hole pattern, which will be further described.

In the left-hand orientation cabinet carcass with a face frame arrangement, shoulder bolt 368 is positioned in hole 354. Shoulder bolt 398 is positioned in hole 367. Shoulder bolt 370 is positioned in hole 374. Shoulder bolt 372 is position in hole 350.

Figure 4A:
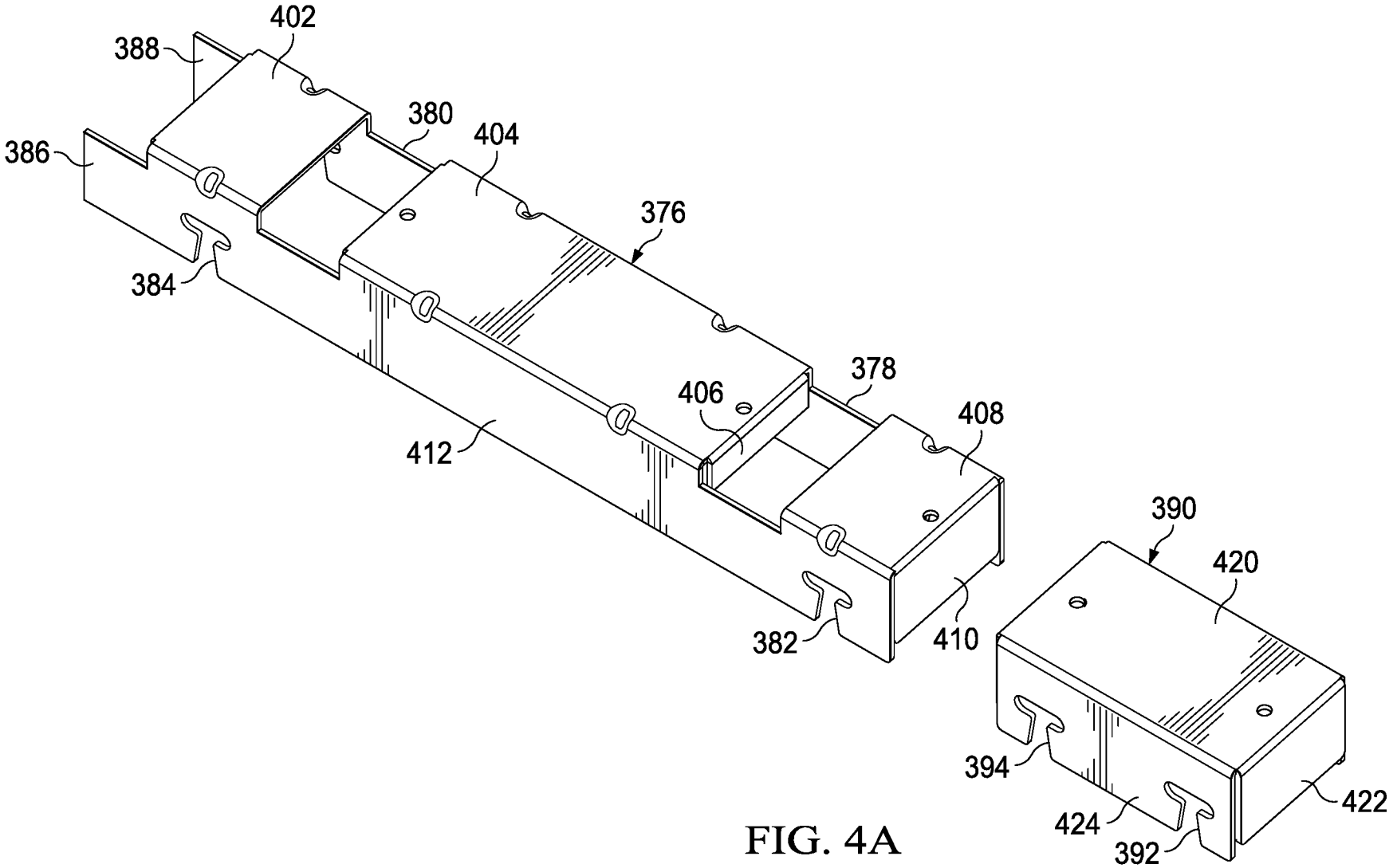
FIG. 4A is an isometric view of orientation bracket and stabilizer.
Figure 4B:
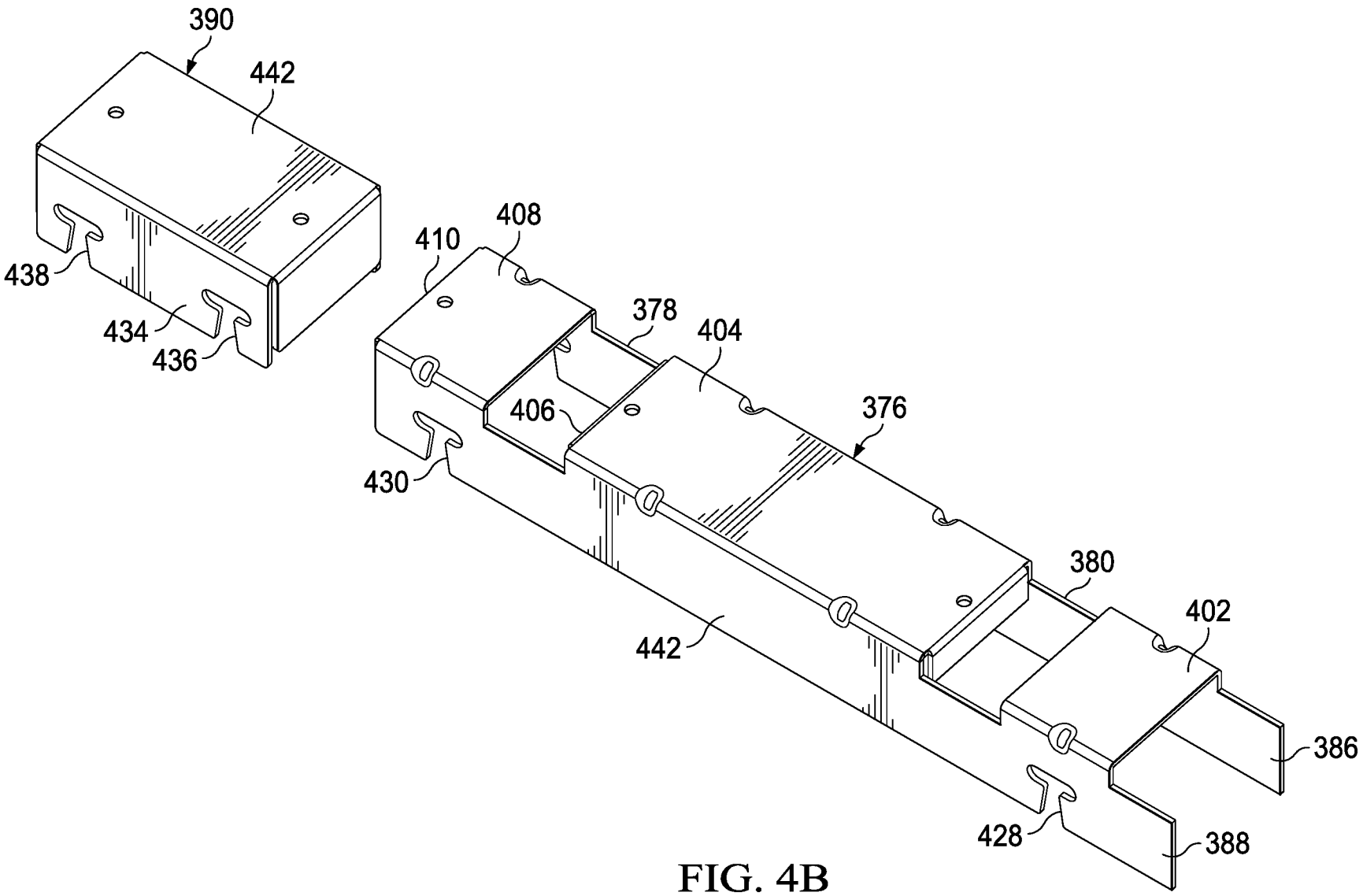
FIG. 4B is an isometric view of orientation bracket and stabilizer.

Referring to FIGS. 3, 4A and 4B orientation bracket 376 and stabilizer 390 will be further described.

The orientation bracket has side face 412 and side face 442.

Side face 412 is generally rectangular in shape with t-slots 384 and 382. Side face 412 also includes guide slot 380 and guide slot 378. Side face 412 includes integrally formed extension 386 adjacent t-slot 384.

Side face 442 is generally rectangular in shape with t-slots 428 and 430. Side face 442 also includes guide slot 380 and guide slot 378. Side face 442 includes integrally formed extension 388 adjacent t-slot 428.

Side faces 412 and 442 are preferably mirror images. The side faces each have a height of between about 1 inch and about 2½ inches. The extensions have a height between about ¾ inches and about 1¾ inches and a length of between about ¾ inches and about 2 inches.

Guide slot 378 is located between about 1½ inches and about 2¼ inches from the end of the side face. Guide slot 378 is between about 1 inch and about 1½ inches wide and between about ¼ inches and about 1 inch deep.

Guide slot 380 is located between about 2" and about 4½" from the end of the extension. Guide slot 380 is between about 1" and about 1½" wide and between about ¼" and about 1" deep.

The distance between the guide slots 378 and 380 is between about 5½" and about 10".

The distance from the end of the side face to t-slot 382 is between about ½" and about 1½". The distance from the end of the extension to t-slot 384 is between about 1½" and about 3".

The distance from the end of the side face to t-slot 430 is between about ½" and about 1½". The distance from the end of the extension to t-slot 428 is between about 1½" and about 3".

All the t-slots should have substantially the same size and shape. Height of the t-slots is be between about ¾" and about 2".

The orientation bracket further includes cap 404. Cap 404 is generally rectangular in shape and extends between guide slots 380 and 378. Cap 404 further includes supports which extend substantially perpendicularly from cap 404 downward between side faces 412 and 442. Support 406 is adjacent guide slot 378 and another support (not shown) is adjacent guide slot 380. In the preferred embodiment, cap 404 and supports are integrally formed. In another embodiment, supports are welded to cap 404. In each case, the supports form surfaces to direct the travel of guide rollers of the vertical stanchion sub-assembly, as will be further described.

The orientation bracket further includes cap 408, cap 410, and cap 402. Cap 408 is substantially rectangular in shape and is adjacent guide slot 378. Cap 410 is located substantially perpendicular between the side faces and cap 408. Cap 402 is connected to the side faces and adjacent guide slot 380. The width of the top caps is between about 1¾" and about 2½".

Stabilizer 390 includes side faces 422, 424, 434, and 440 and cap 420. The side faces are generally rectangular. Side faces 424 and 434 are generally parallel. Side faces 422 and 440 are connected generally perpendicularly to side faces 424 and 434. Side face 424 includes t-slots 392 and 394. Side face 434 includes t-slots 436 and 438. Cap 420 is connected to the four side faces.

In a preferred embodiment, the length of the stabilizer is between about 3½" and about 5". The width of the stabilizer is the same as the width of the top caps of the orientation bracket. The t-slots of the stabilizer are similar to the t-slots of the orientation bracket. The t-slots are located between about ¼ inches and about 1 inch from the ends of the stabilizer.

Figure 5:
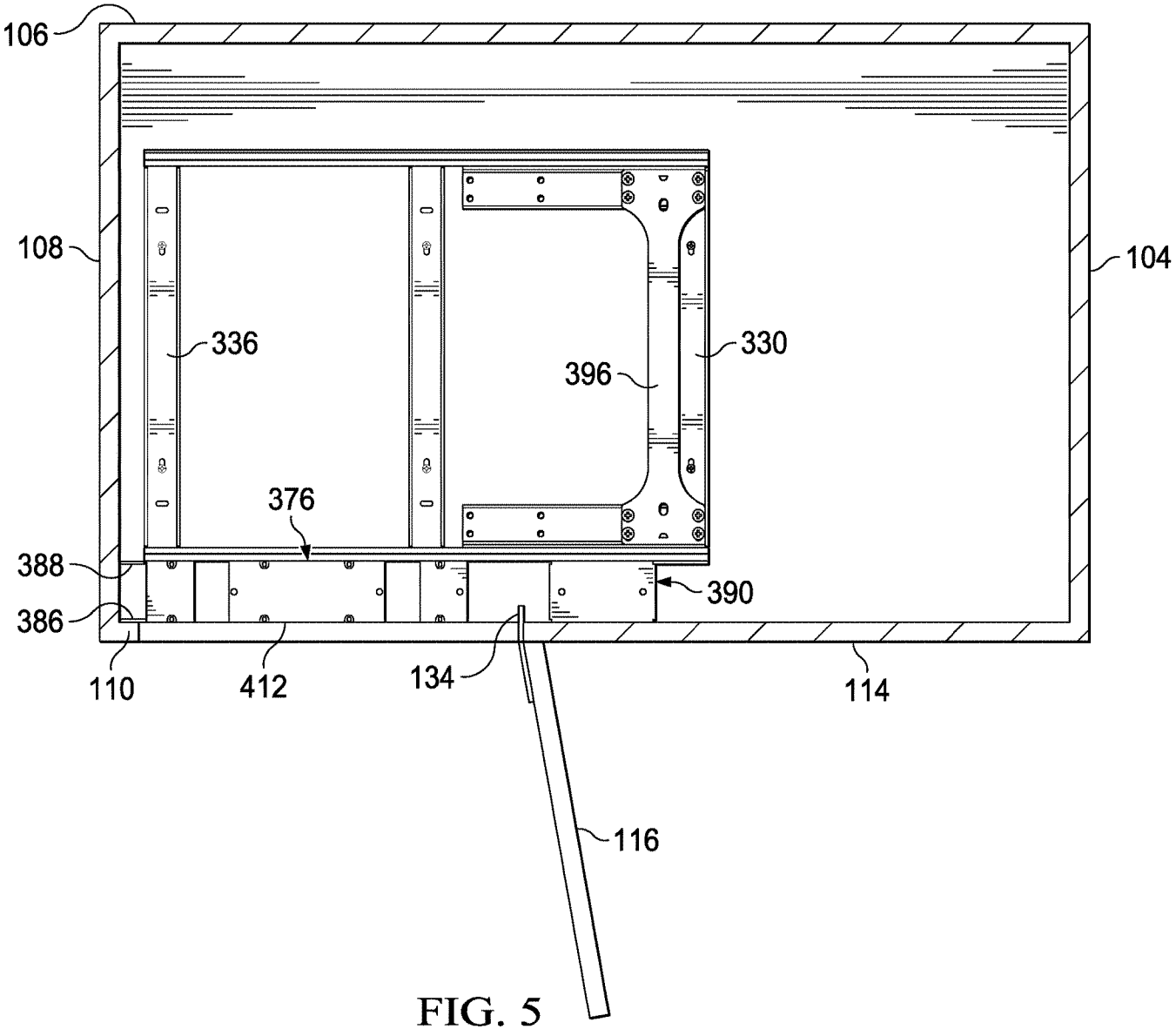
FIG. 5 is a plan view of a base assembly installed in a left side blind cabinet carcass with a face frame.

Referring to FIG. 5, installation in a left-hand orientation cabinet carcass, with a face frame, will be described. Extensions 386 and 388 are positioned adjacent door opening crossbar 336 and opposite cross brace 396. Shoulder bolt 368 is positioned in t-slot 428. Shoulder bolt 398 is positioned in t-slot 430. Shoulder bolt 370 is positioned in t-slot 436. Shoulder bolt 372 is positioned in t-slot 438. Extensions 386 and 388 abut door side wall 108. Extension 386 and side face 412 further abuts face frame 110. Side face 442 abuts rail 304. Stabilizer 390 abuts front wall 114. Hinge 134 can extend into the cabinet carcass into the gap between the orientation bracket and the stabilizer. The door opening cross bar is located adjacent to the door side wall and the blind side cross bar is located facing toward blind side wall 104.

Figure 6A:
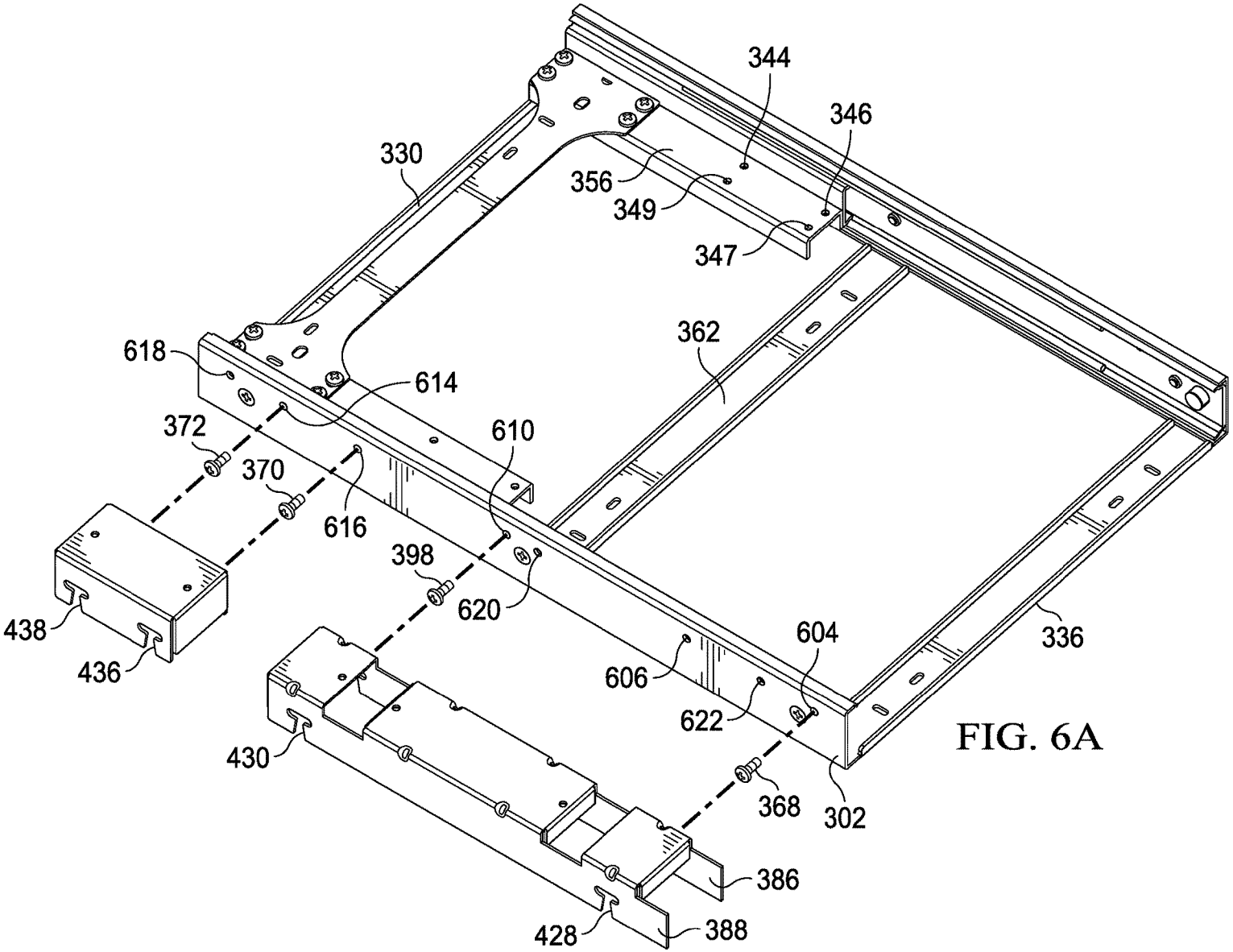
FIG. 6A is an exploded isometric view of a base assembly in right side face frame position.
Figure 6B:
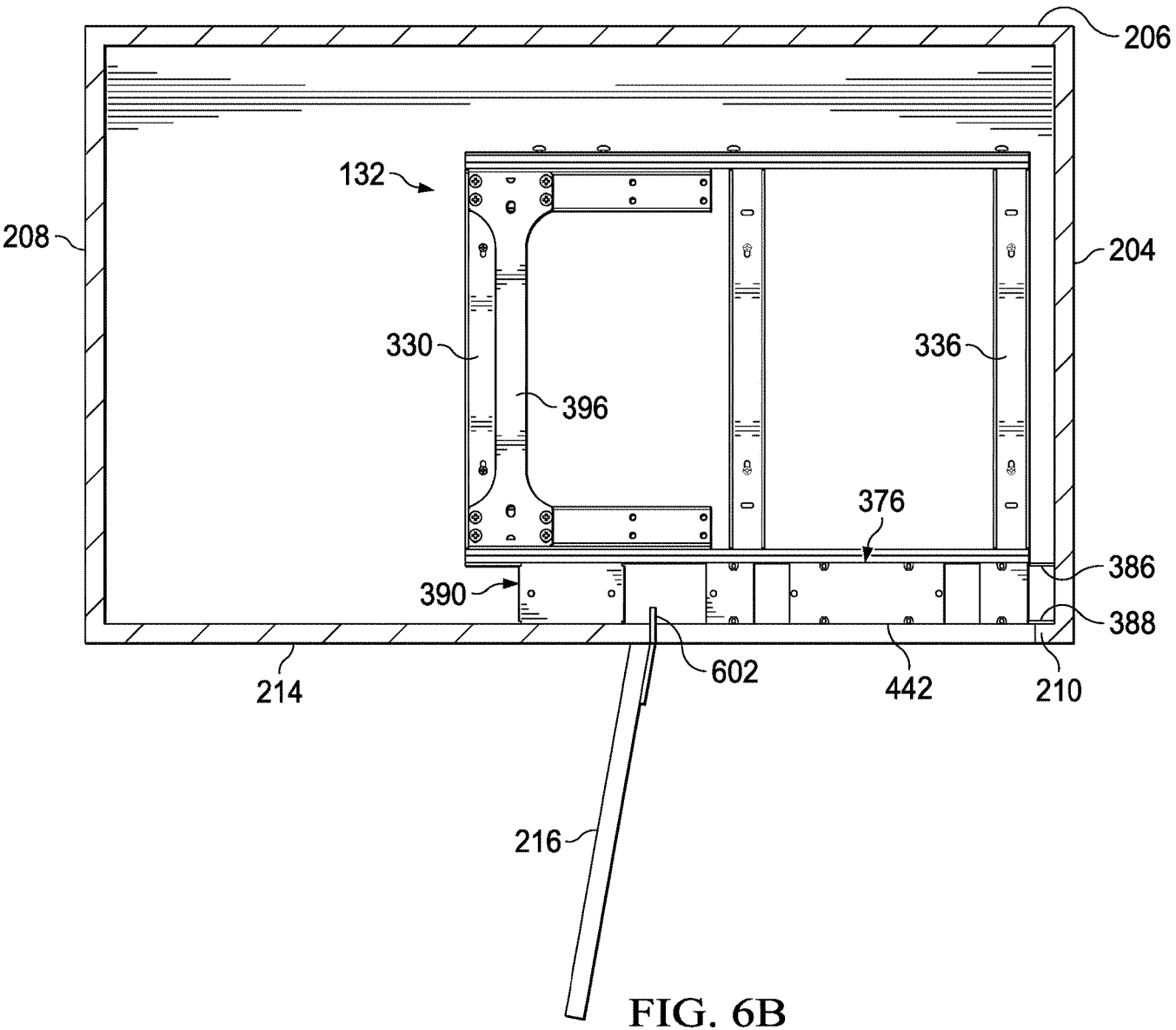
FIG. 6B is a plan view of a base assembly installed in a right side blind cabinet carcass with a face frame.

Referring to FIGS. 6A and 6B, installation in a right-hand oriented cabinet carcass with a face frame arrangement will be described.

Rail 302 further includes holes 618, 614, 616, 610, 620, 606, 622, and 604. Holes 604 and 622 are located adjacent to door opening crossbar 336. Hole 606 is located between the door opening cross bar and the central cross bar. Holes 620 and 610 are located adjacent central crossbar 362. Hole 616 is located between the central cross bar and the blind side cross bar. Holes 614 and 618 are located adjacent blind side cross bar 330.

Shoulder bolt 372 is fitted in hole 614. Shoulder bolt 370 is fitted in hole 616. Shoulder bolt 398 is fitted in hole 610 and shoulder bolt 368 is fitted in hole 604.

Orientation bracket 376 is installed on rail 302. T-slot 382 is positioned on shoulder bolt 398. T-slot 384 is position on shoulder bolt 368. Extensions 386 and 388 are located adjacent door opening crossbar 336. Stabilizer 390 is installed on rail 302. T-slot 392 is positioned on shoulder bolt 372. T-slot 394 is positioned on shoulder bolt 370.

Orientation bracket abuts face frame 210 along side face 442 with extensions extending to the door side wall 204. Stabilizer abuts front wall 214. Hinge 602 to door 216 can extend into the cabinet carcass into the gap between the orientation bracket and the stabilizer. The door opening cross bar of the base assembly is adjacent door side wall 204. Blind side cross bar is positioned toward blind side wall 208.

Flange 356 includes holes 344, 346, 347, and 349.

Figure 7A:
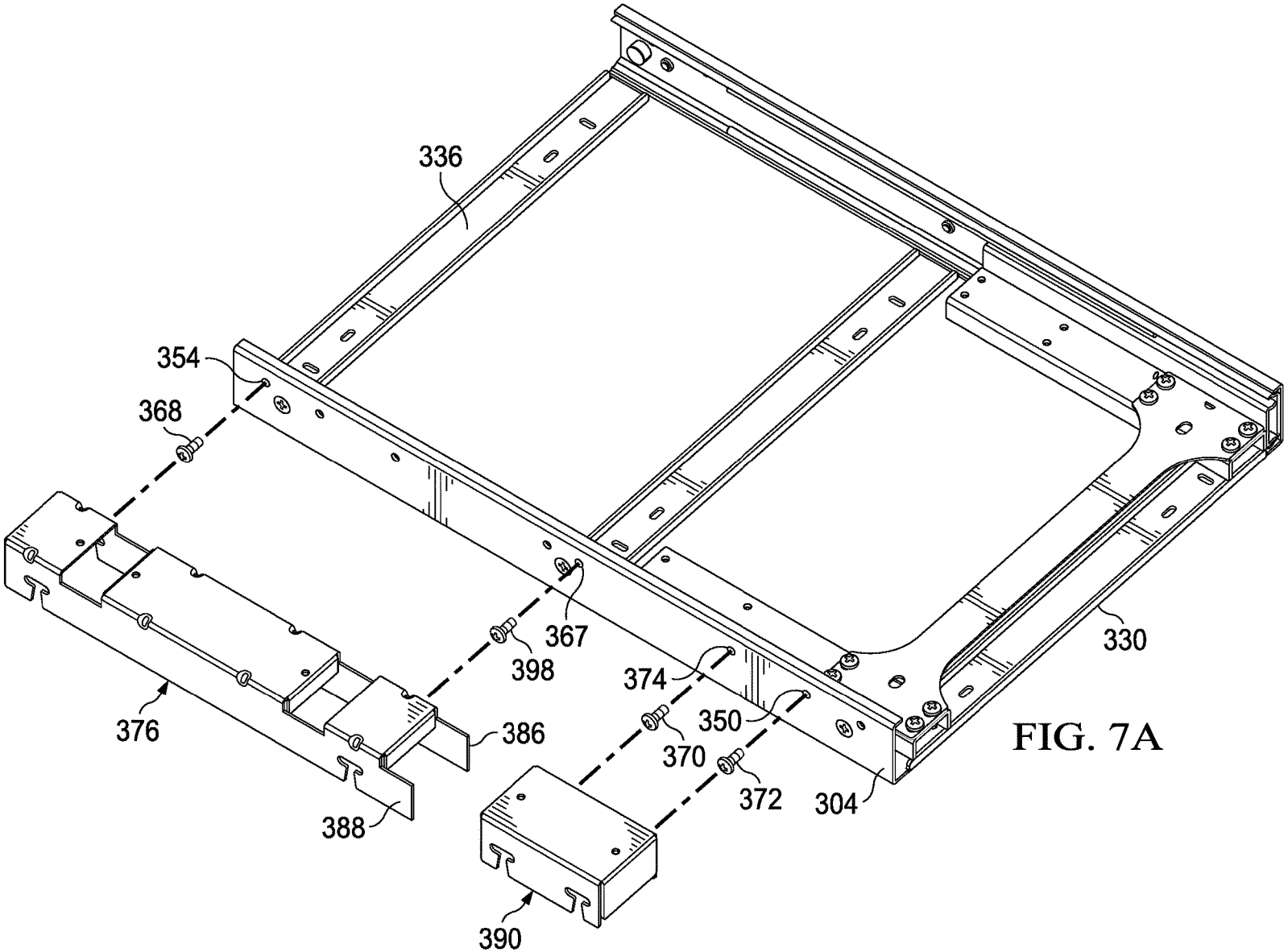
FIG. 7A is an exploded isometric view of a base assembly in left side no face frame position.
Figure 7B:
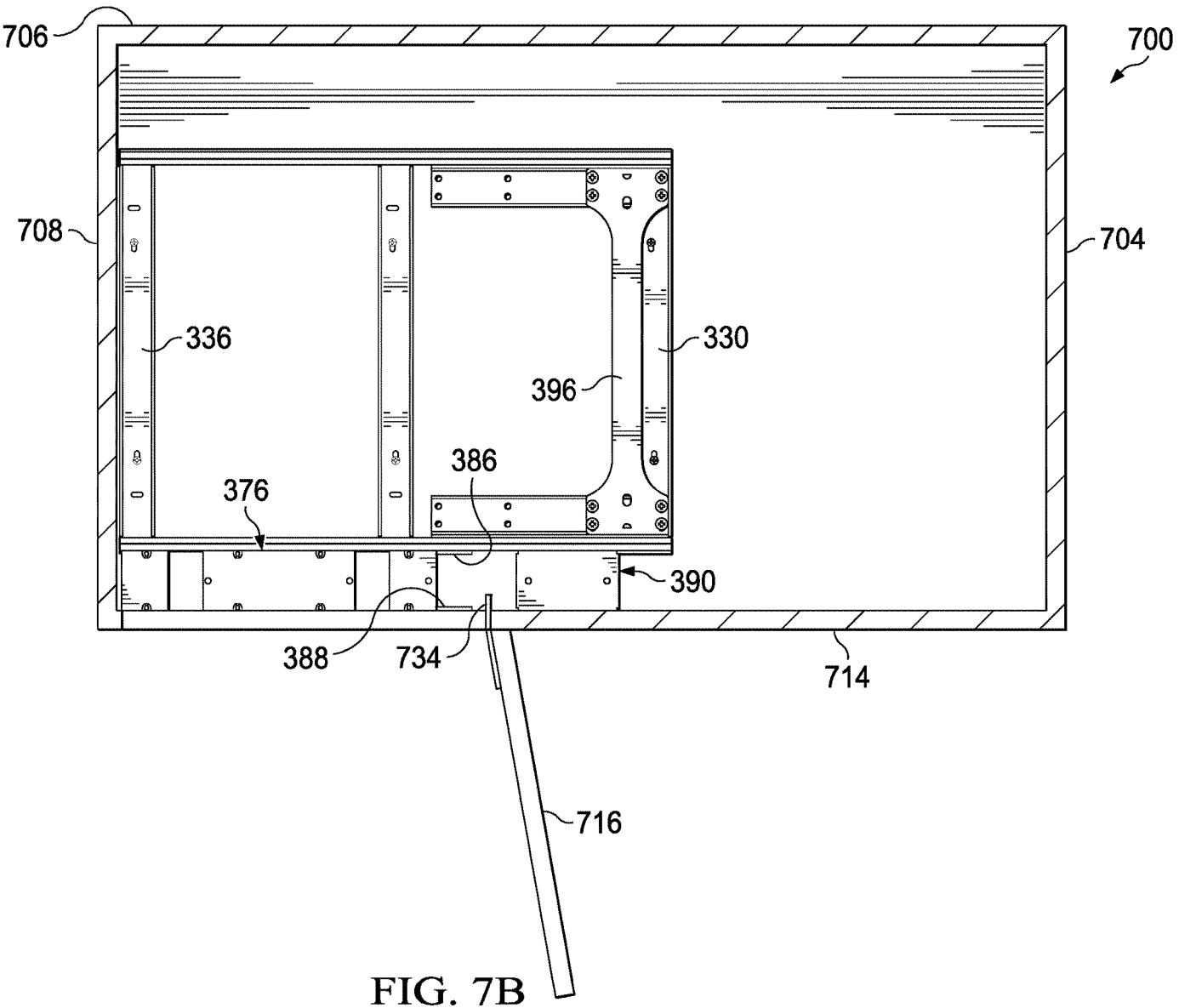
FIG. 7B is a plan view of a base assembly installed in a left side blind cabinet carcass with no face frame.

Referring to FIGS. 7A and 7B, installation in a left-hand oriented cabinet carcass without a face frame will be described.

Shoulder bolt 368 is fitted in hole 354. Shoulder bolt 398 is fitted in hole 367. Shoulder bolt 370 is fitted in hole 374. Shoulder bolt 372 is fitted in hole 350. Orientation bracket 376 is installed on rail 304. T-slot 382 is positioned on shoulder bolt 368. T-slot 384 is positioned on shoulder bolt 398. Extensions extend toward the stabilizer. Stabilizer is installed on rail 304. T-slot 436 is positioned on shoulder bolt 370. T-slot 438 is positioned on shoulder bolt 372.

Left no face frame cabinet carcass 700 includes door side wall 708, back wall 706, blind side wall 704, front wall 714 and door 716. The orientation bracket abuts door side wall 708, with the extensions directed away from door side wall 708. The stabilizer abuts front wall 714. Hinge 734 to door 716 can extend into the cabinet carcass between the gap between the orientation bracket and the stabilizer. The door opening crossbar 336 abuts door side wall 708 and blind side cross bar faces toward blind side wall 704.

Figure 8A:
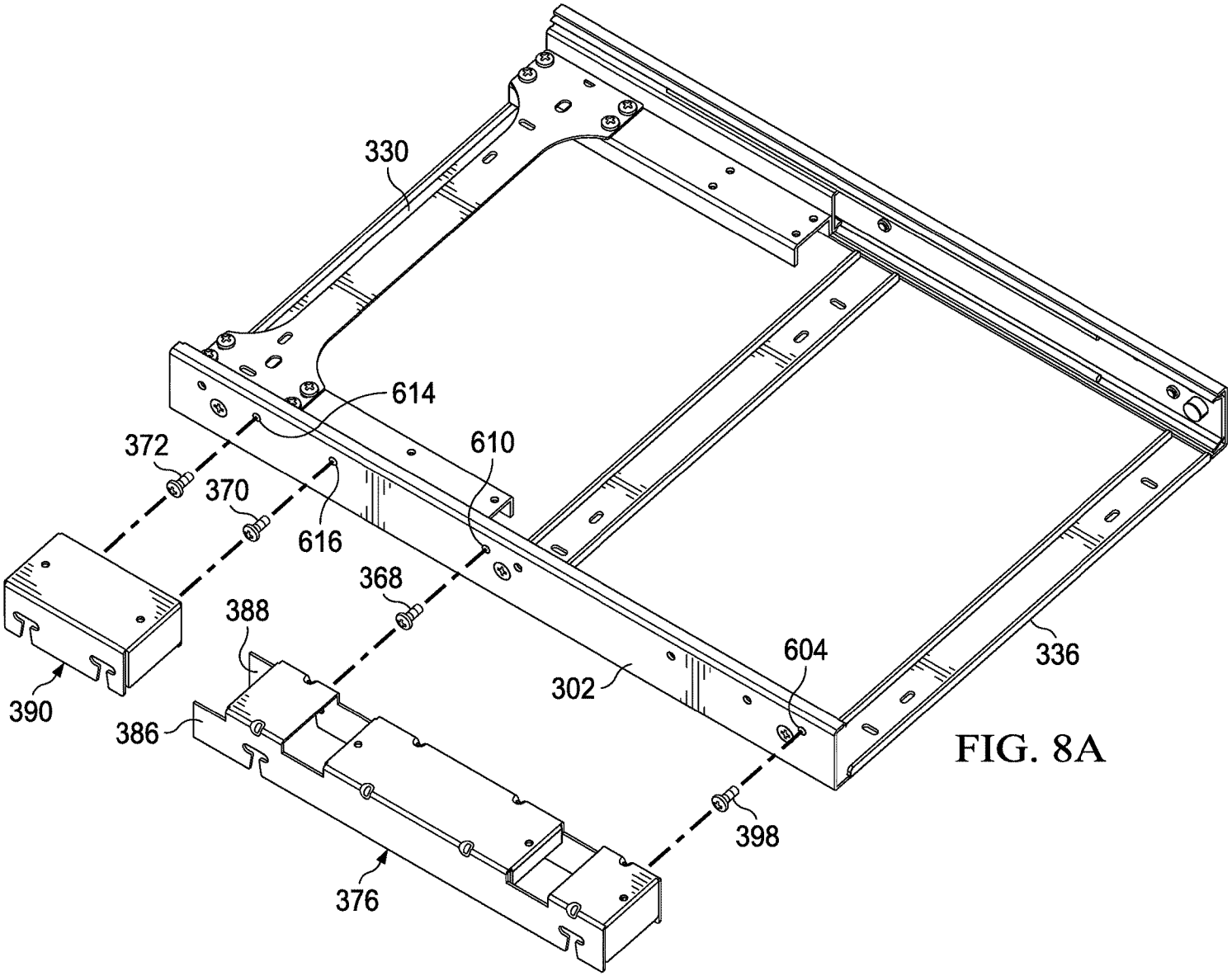
FIG. 8A is an exploded isometric view of a base assembly in right side no face frame position.
Figure 8B:
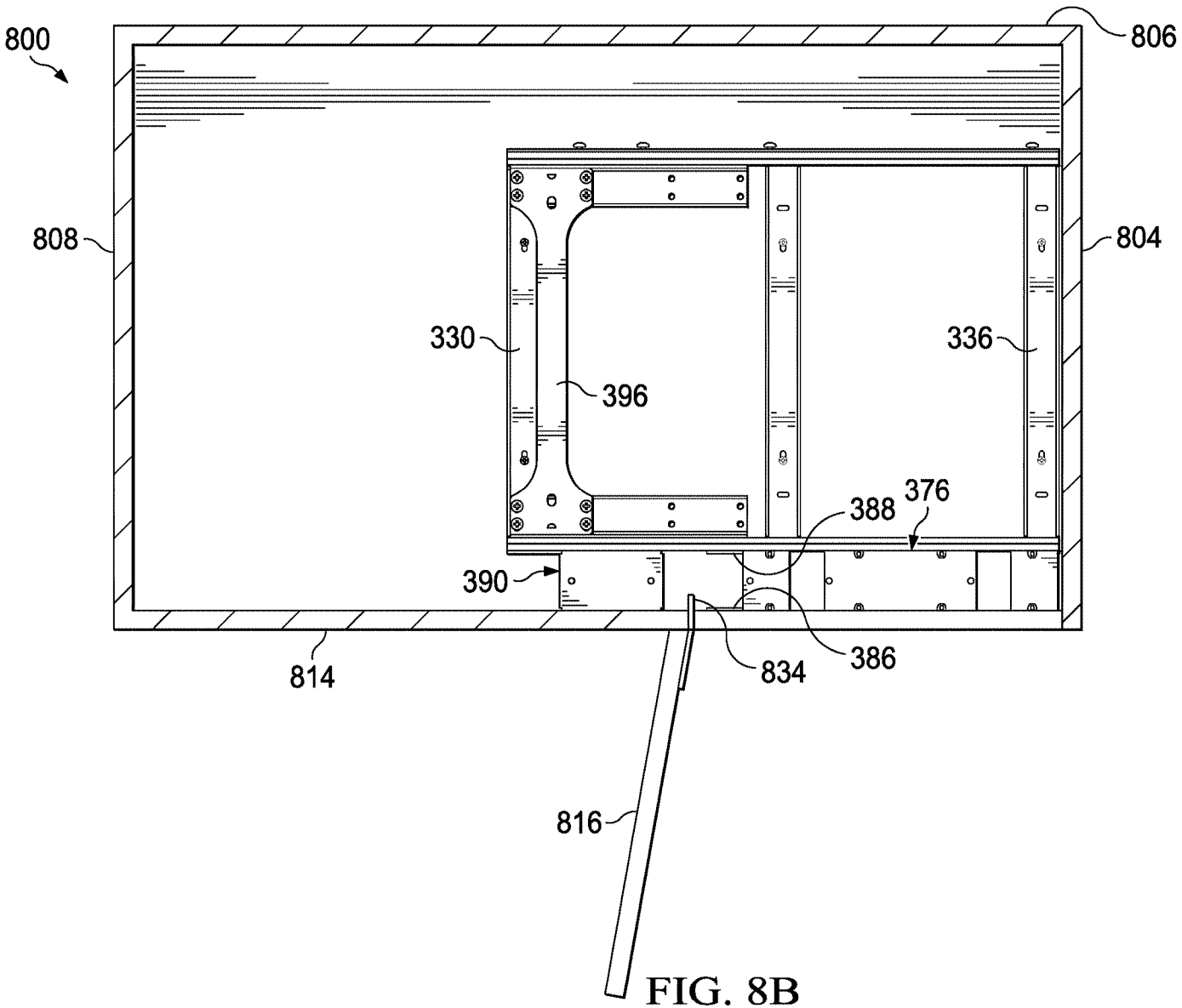
FIG. 8B is a plan view of a base assembly installed in a right side blind cabinet carcass with no face frame.

Referring to FIGS. 8A and 8B, installation in a right-hand oriented cabinet carcass without a face frame will be described.

Shoulder bolt 372 is fitted in hole 614. Shoulder bolt 370 is fitted in hole 616. Shoulder bolt 368 is fitted in hole 610. Shoulder bolt 398 is fitted in hole 604. Orientation bracket 376 is installed on rail 302. T-slot 430 is positioned on shoulder bolt 398. T-slot 428 is positioned on shoulder bolt 368. The extensions are directed toward the stabilizer. Stabilizer is installed on rail 302. T-slot 394 is fitted on shoulder bolt 370. T-slot 392 is positioned on shoulder bolt 372.

Right no face frame cabinet carcass 800 includes door side wall 804, back wall 806, blind side wall 808, front wall 814 and door 816. The orientation bracket abuts door side wall 804, with extension 388 extending away from door side wall 804. The stabilizer abuts front wall 814. Hinge 834 to door 816 can extend into the cabinet carcass into the gap between the orientation bracket and the stabilizer. The door opening crossbar 336 abuts door side wall 804 and blind side cross bar faces toward blind side wall 808.

Figure 9:
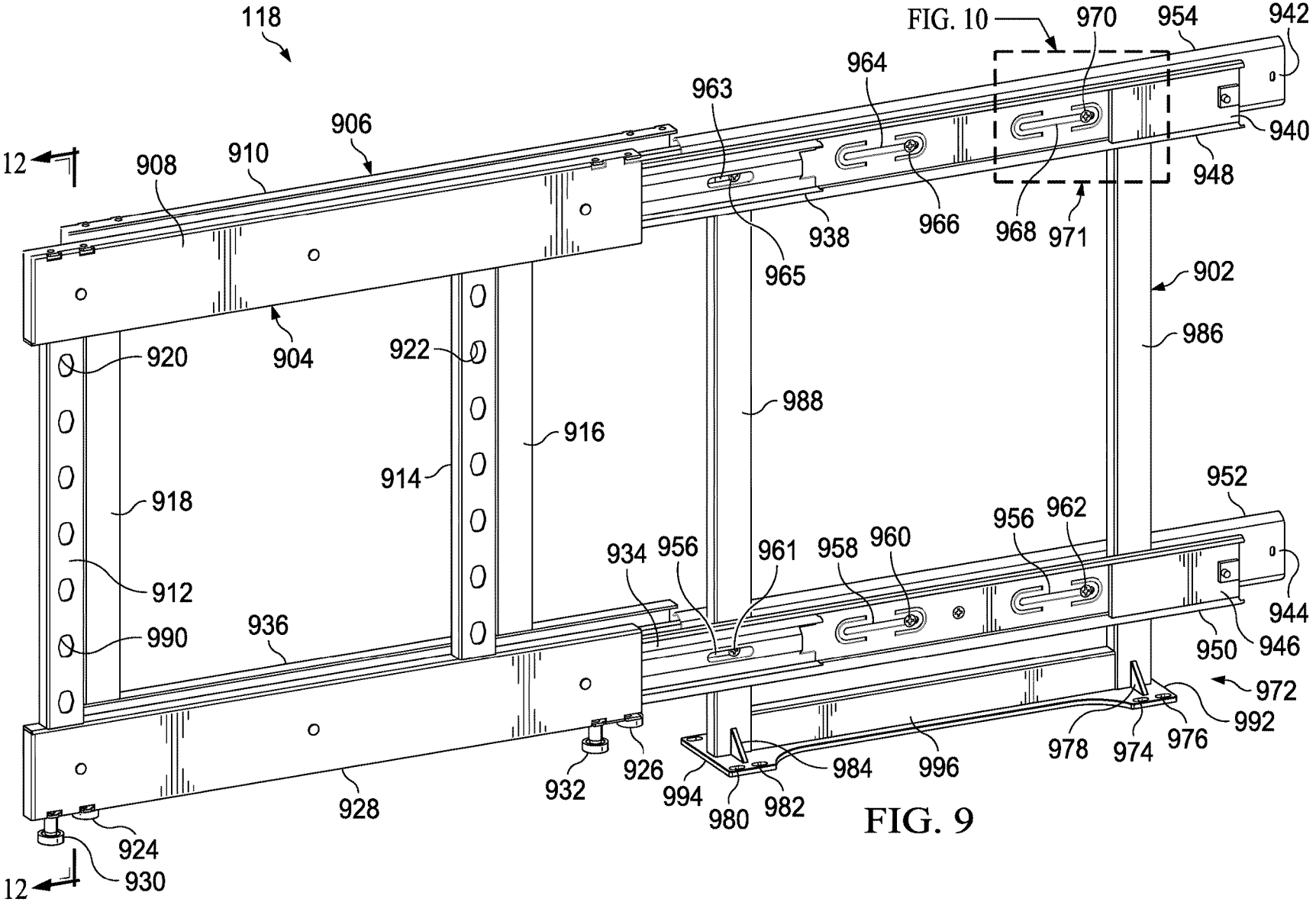
FIG. 9 is an isometric view of a vertical stanchion assembly.

Referring to FIG. 9, vertical stanchion assembly 118, as will be further described. Vertical stanchion assembly 118 includes central vertical support subassembly 902, right vertical support subassembly 904 and left vertical support subassembly 906.

Right vertical support subassembly 904 comprises slide 940 and slide 946. Slide 940 includes inner rail 948, intermediate rail 938 and outer rail 908. Slide 946 includes inner rail 950, intermediate rail 934 and outer rail 928. Basket support post 912 is connected to outer rail 908 and outer rail 928. Basket support post 914 is connected to outer rail 908 and outer rail 928. Basket support posts 912 and 914 include a plurality of holes, such as holes 920, 990, and 922. Guide roller 930 is pivotally connected to the underside of outer rail 928. Guide roller 932 is pivotally connected to the underside of outer rail 928. Inner rail 948 includes slot 968, slot 964, and slot 963. Screw 970, screw 966, and screw 965 connect inner rail 948 to the vertical support subassembly by way of slot 968, slot 964, and slot 963 as will be further described. Inner rail 950 includes slot 956, slot 958, and slot 959. Screw 962, screw 960, and screw 961 connect inner rail 950 to the central vertical support subassembly, as will be further described.

Left vertical support subassembly 906 comprises slide 942 and slide 944. Slide 942 includes inner rail 954, an intermediate rail (not shown), and outer rail 910. Slide 944 includes inner rail 952, an intermediate rail (not shown), and outer rail 936. Basket support post 918 is connected to outer rail 910 and outer rail 936. Basket support post 916 is connected to outer rail 910 and outer rail 936. Basket support posts 918 and 916 include a plurality of equally spaced holes on the exterior of one side, as will be further described. Guide roller 924 is connected to the underside of outer rail 936. Guide roller 926 is connected to the underside of outer rail 936. Inner rails 952 and 954 include slots and screws which connect them to the central vertical support subassembly, as will be further described.

In an alternative embodiment, slides 940, 942, 944, and 946 each include a soft close mechanism such as shown in U.S. Pat. No. 8,590,989 to Lowe, is incorporated herein by reference.

Central vertical support subassembly 902 includes vertical stanchion support plate 972, rear vertical rail support 986, fixed forward vertical rail support 988, fixed lower horizontal brace 996 and an upper and lower fixed horizontal rail support, as will be further described. Vertical stanchion support plate 972 includes flange 992 and flange 994. Flange 992 includes holes 974 and 976. Flange 994 includes holes 980 and 982. Rear vertical rail support 986 is perpendicularly connected to the vertical stanchion support plate. Forward vertical rail support 988 is perpendicularly connected to the vertical stanchion support plate. Lower horizontal brace 996 is perpendicularly connected to the vertical stanchion support plate. Lower horizontal brace 996 is further perpendicularly connected to the fixed rear vertical rail support and fixed forward vertical rail support 988. Angular brace 978 is connected to both the vertical stanchion support plate and the fixed rear vertical rail support to provide stability. Angular brace 984 is connected to both the vertical stanchion support plate and the fixed forward vertical rail support to provide stability. Similar angular supports (not shown) are located on the opposite side of the fixed forward vertical rail support and the fixed rear vertical rail support, as will be further described.

Figure 10:
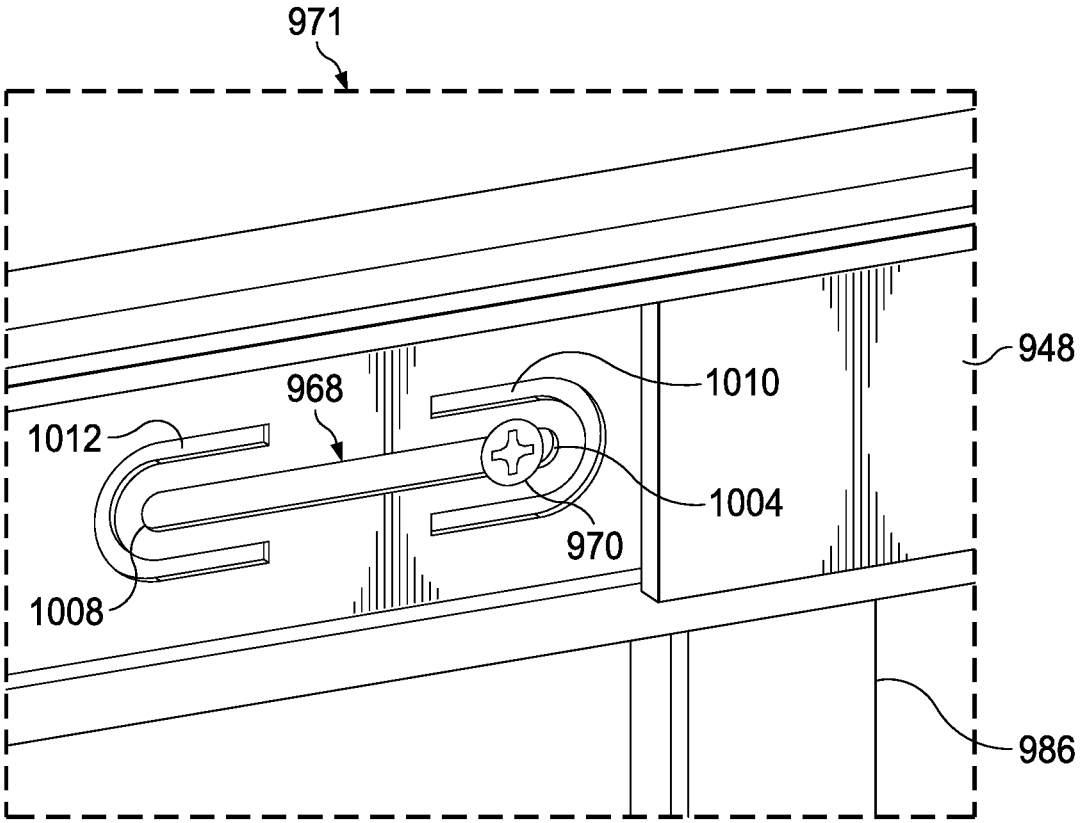
FIG. 10 is a detail view from a vertical stanchion assembly.

Detail 971 is shown in FIG. 10. A horizontal slot, such as horizontal slot 968, is provided in forward and rear positions on inner rail of each of the slides. The slots allow easy longitudinal repositioning of the slides relative to the vertical rail support. For example, slot 968 includes distal end 1008 and proximal end 1004. Distal end 1008 is positioned away from the fixed rear vertical rail support. Proximal end 1004 is positioned to the fixed rear vertical rail support. Semicircular slots 1010 and 1012 are provided around slot 968 in inner rail 948 to relieve stress and prevent deformation of the inner rail and/or the vertical rail support resulting from screw 970 when the rail is mounted. Similar semicircular slots (not shown) are provided adjacent slots 956, 958, 959, 964 and 963 to relieve stress and prevent deformation when the slides are mounted.

Figure 11:
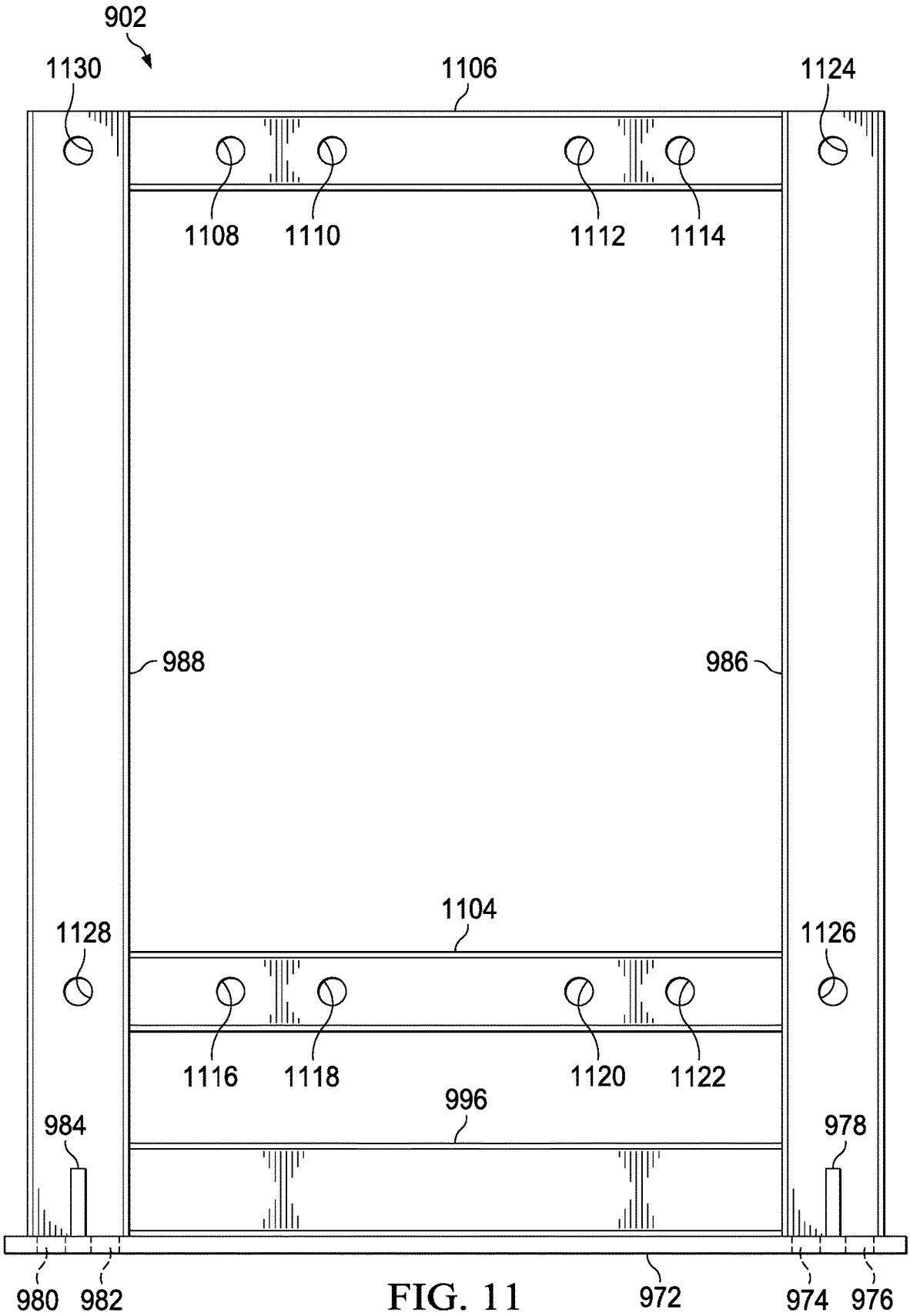
FIG. 11 is a side view of a vertical support subassembly.

Referring to FIG. 11, central vertical support subassembly 902 will be further described. Fixed lower horizontal rail support 1104 is connected to fixed forward vertical rail support 988 and fixed rear vertical rail support 986. The fixed lower horizontal rail support includes threaded holes 1116, 1118, 1120, and 1122. Threaded holes 1116 and 1118 are located adjacent fixed forward vertical rail support 988. Threaded holes 1120 and 1122 are located adjacent fixed rear vertical rail support 986. Upper fixed horizontal rail support 1106 is connected to the fixed forward vertical rail support and the fixed rear vertical rail support. The upper fixed horizontal rail support includes threaded holes 1108, 1110, 1112, and 1114. Threaded holes 1108 and 1110 are located adjacent the fixed forward vertical rail support. Threaded holes 1112 and 1114 are located adjacent the fixed rear vertical rail support. Fixed forward vertical rail support 988 includes threaded holes 1128 and 1130. Fixed rear vertical rail support 986 includes threaded holes 1124 and 1126. Threaded holes 1128 and 1126 are aligned with threaded holes 1116, 1118, 1120, and 1122. Threaded holes 1130 and 1124 are aligned with threaded holes 1108, 1110, 1112, and 1114.

Referring to FIGS. 9 and 11, the attachment of slides 940, 942, 944, and 946 to the central vertical support subassembly will be described. Slide 940 is attached to the upper fixed horizontal rail support by use of screws 970, 966, and 965. Screw 970 is positioned in the proximal end of slot 968 and threaded in threaded hole 1114. Screw 966 is positioned in the proximal end of slot 964 and threaded in threaded hole 1110. Screw 965 is positioned in the proximal end of slot 963 and threaded in threaded hole 1130. Slide 942 is attached to the upper fixed horizontal rail support by three screws. The screws are positioned in the distal ends of the slots on slide 942 and are threaded in threaded holes 1108, 1112, and 1124. Slide 946 is attached to fixed lower horizontal rail support 1104 by screws 962, 960, and 961. Screw 962 is positioned in the proximal end of slot 956 and threaded in threaded hole 1122. Screw 960 is positioned in the proximal end of slot 958 and threaded in threaded hole 1118. Screw 961 is positioned in the proximal end of slot 959 and threaded in threaded hole 1128. Slide 944 is attached to the lower fixed horizontal rail support by use of three screws. The screws are positioned in the distal ends of the slots on slide 944 and threaded in threaded holes 1116, 1120, and 1126. The positioning of the screws to the forward or rear of the slots is determined by the right or left-hand orientation of the cabinet, as will be further described.

Figure 12:
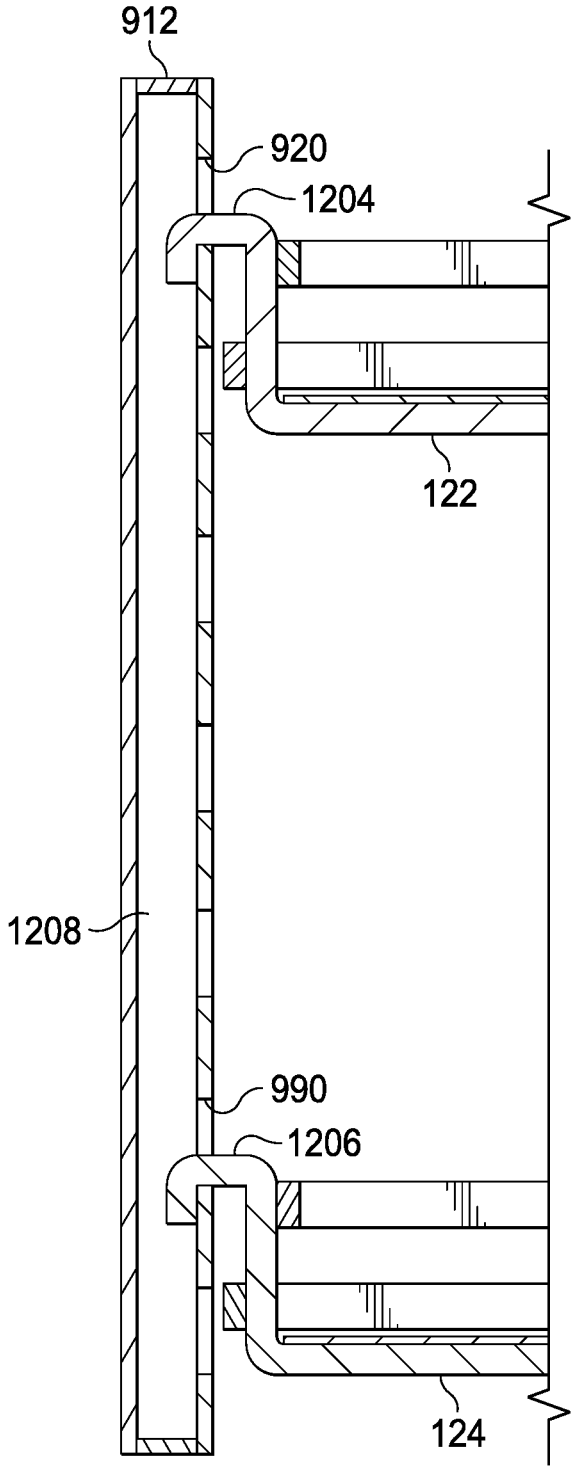
FIG. 12 is a cross-section view of a basket support post.

Referring to FIG. 12, a vertical cross-section of basket support post 912, will be described. Basket support post 912 includes interior channel 1208 and a plurality of equidistant holes, such as hole 920 and hole 990. Baskets are connected to the basket support posts. For example, primary baskets 122 and 124 are connected to basket support post 912 by hooks 1204 and 1206. Hooks enter the channel through the holes. Basket support posts 914, 916, and 918 have similar channels and holes for retaining hooks on the primary and secondary baskets.

Figure 13:
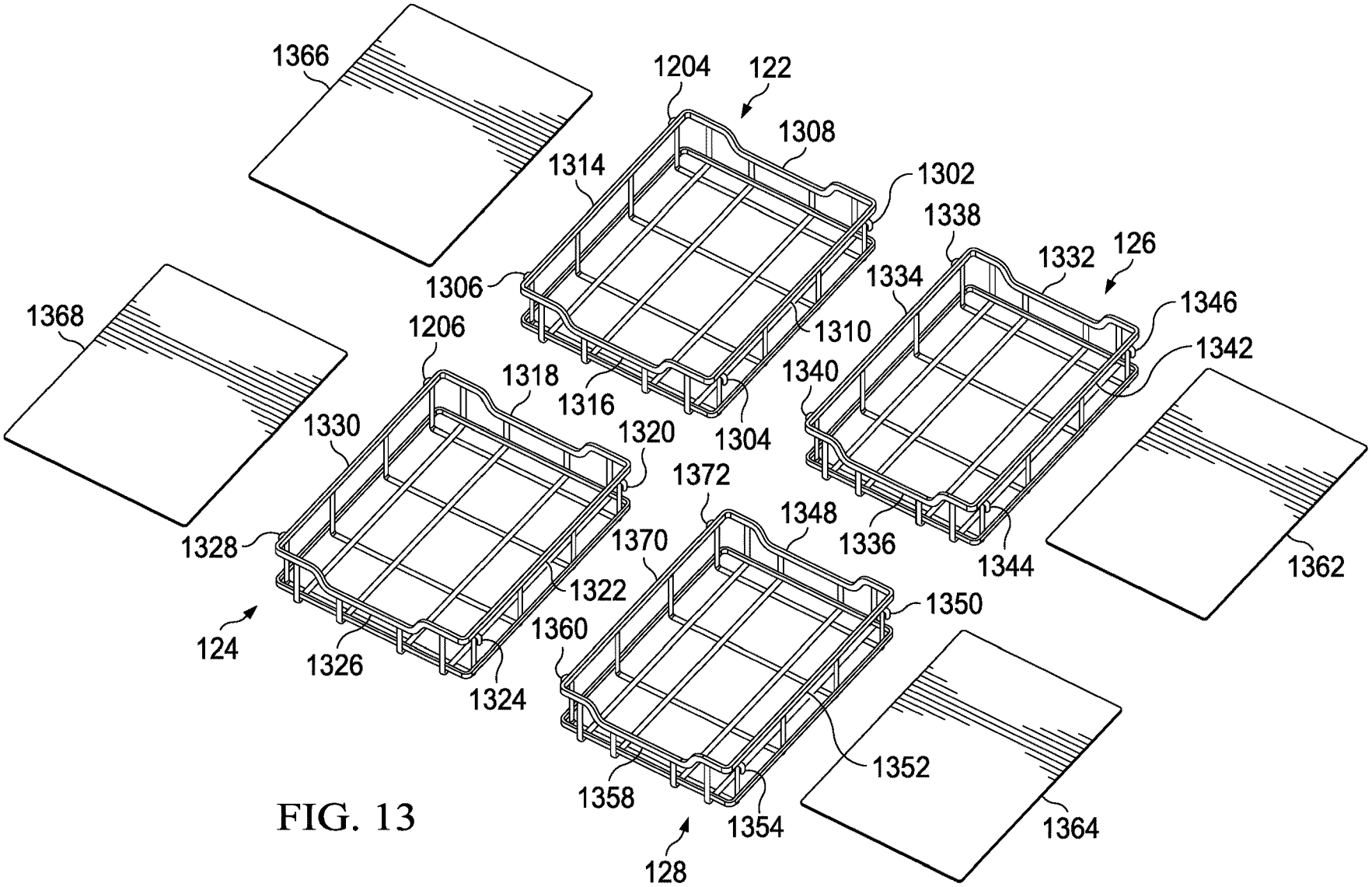
FIG. 13 is an exploded isometric view of baskets and liners.

Referring to FIG. 13, primary baskets 122 and 124 and secondary baskets 126 and 128, will be further described.

In a preferred embodiment, the primary baskets, such as primary basket 122 are composed of a wire frame having vertical sides 1314, 1308, 1310, and 1316. Hooks 1204 and 1306 are provided on side 1314. Hooks 1302 and 1304 are provided on side 1310. In a preferred embodiment, primary basket 124 is comprised of a wire frame having sides 1318, 1330, 1326, and 1322. Hooks 1206 and 1328 are provided on side 1330. Hooks 1320 and 1324 are provided on side 1322. Reusable plastic liners 1366 and 1368 are positioned in the bottom of the baskets.

In a preferred embodiment, the secondary baskets, such as secondary basket 126 are comprised of a wire frame having sides 1332, 1334, 1336, and 1342. Hooks 1338 and 1340 are provided on side 1334. Hooks 1346 and 1344 are provided on side 1342. Secondary basket 128 is comprised of a wire frame having sides 1348, 1370, 1358, and 1352. Hooks 1372 and 1360 are provided on side 1370. Hooks 1350 and 1354 are provided on side 1352. Liners 1362 and 1364 are positioned in the bottom of the secondary baskets.

The primary baskets are between 8½" and 20" wide and between 10" and 20" long. The secondary baskets are between 7½" and 16" wide and between 10" and 20" long. In alternative embodiments, the primary and secondary baskets can be made of plastic, metal with no mesh, or wood.

Figure 14A:
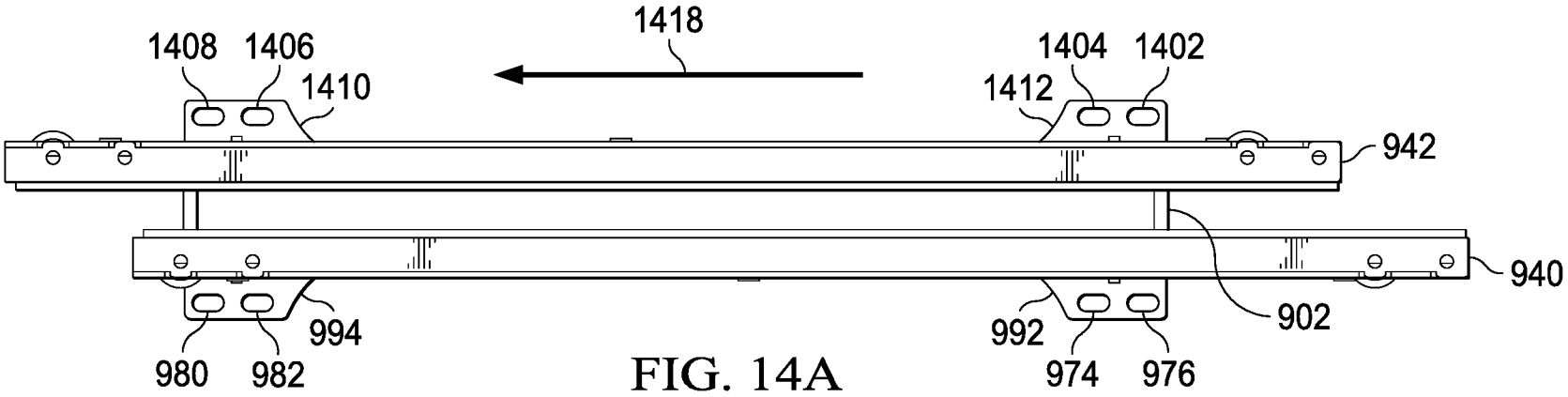
FIG. 14A is a top view of a vertical stanchion assembly in the arrangement for left side blind cabinet carcass.

Referring to FIGS. 9, 10, and 14A, positioning of the slides on the central vertical support sub-assembly in a left-hand vertical slide arrangement will be described. Slide 940 is attached to central vertical support subassembly 902 with screws 970, 966, and 965 adjacent the distal ends of slots 968, 964, and 963. Slide 946 is attached to central vertical support subassembly 902 with screws 961, 960, and 962 adjacent the distal ends of slots 959, 958, and 956. Slide 942 is attached to central vertical support subassembly 902 with screws adjacent the proximal ends of the slots. Slide 944 is attached to the vertical support subassembly with screws adjacent the proximal ends of the slots. Slides 942 and 940 extend in direction 1418.

Flange 1410 includes holes 1408 and 1406. Flange 1412 includes holes 1404 and 1402.

Figure 14B:
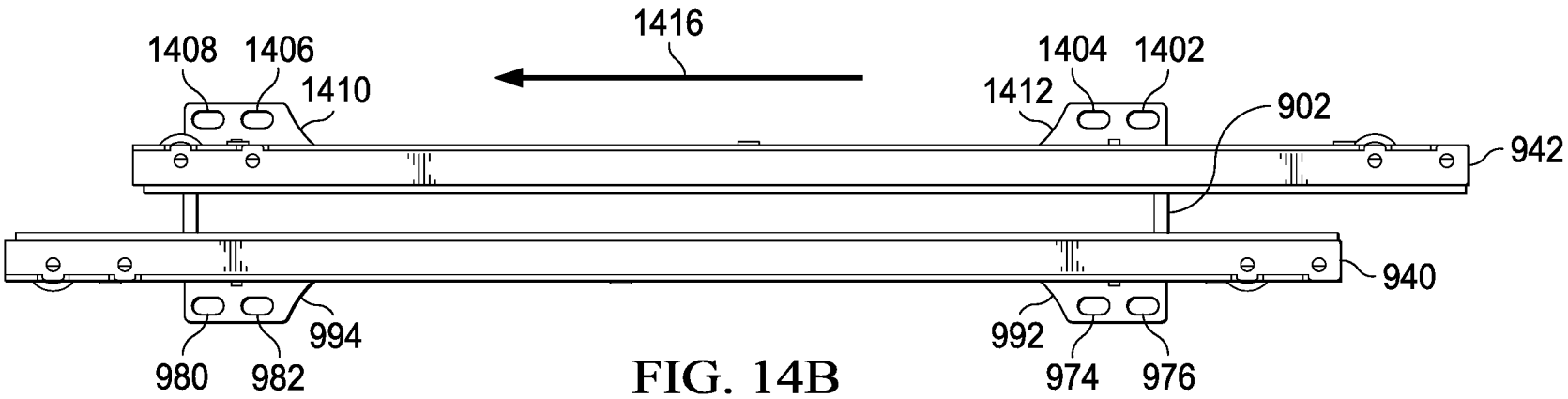
FIG. 14B is a top view of a vertical stanchion assembly in the arrangement for right side blind cabinet carcass.

Referring to FIGS. 9, 10, and 14B, the positioning of the slides on the central vertical support sub-assembly in the right-hand vertical slide arrangement will be described. Slide 940 is attached to central vertical support subassembly 902 with screws 970, 966, and 965 adjacent the proximal ends of slots 968, 964, and 963. Slide 946 is attached to the central vertical support subassembly with screws 961, 960 and 962 adjacent the proximal ends of slots 959, 958, and 956. Slide 942 is attached to central vertical support subassembly 902 with screws adjacent the distal ends of the slots. Slide 944 is attached to central vertical support subassembly 902 with screws adjacent the distal ends of the slots. Slides 942 and 940 extend in direction 1416.

Figure 15A:
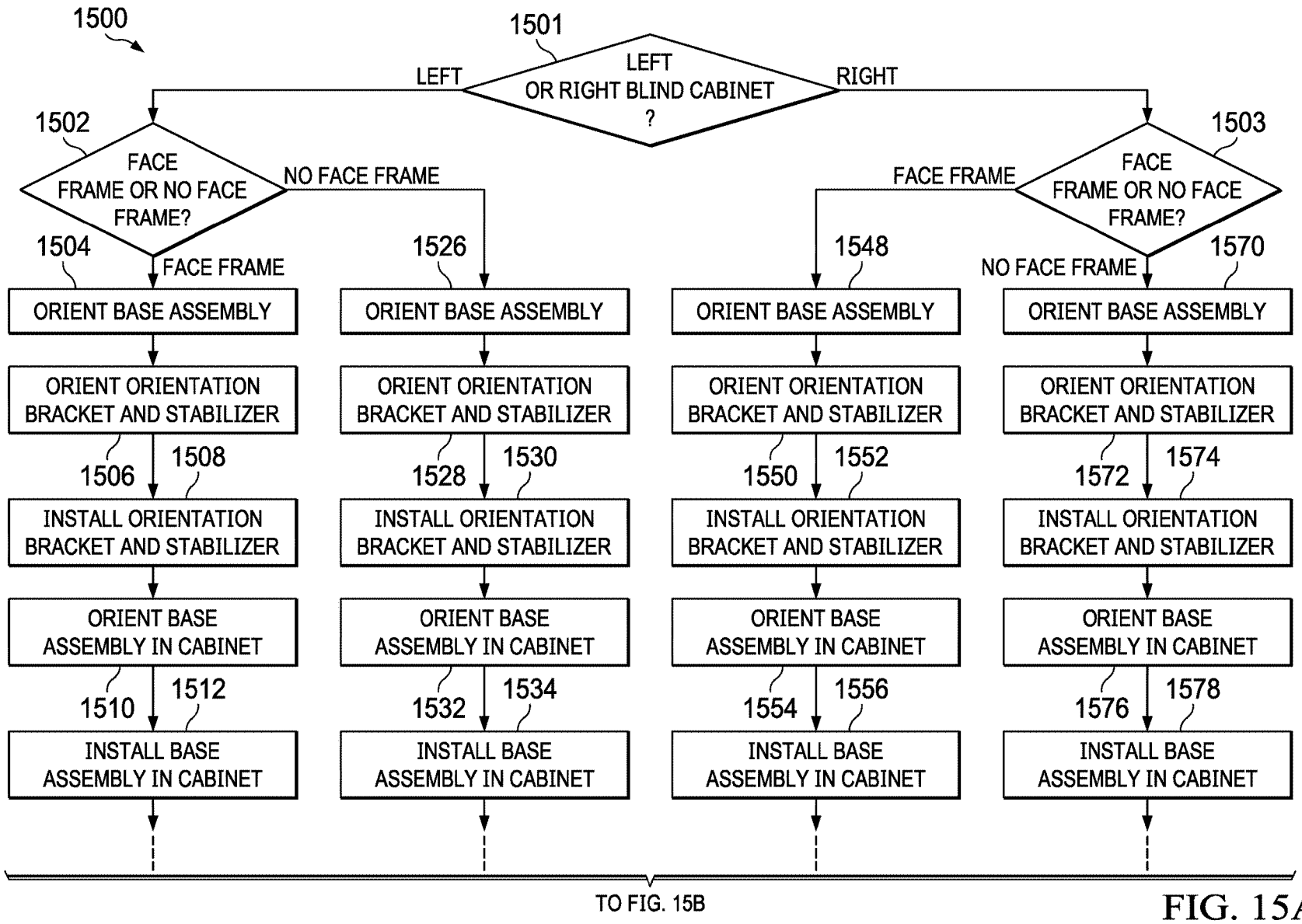
FIGS. 15A and 15B is a flowchart for assembly of a preferred embodiment.
Figure 15B:
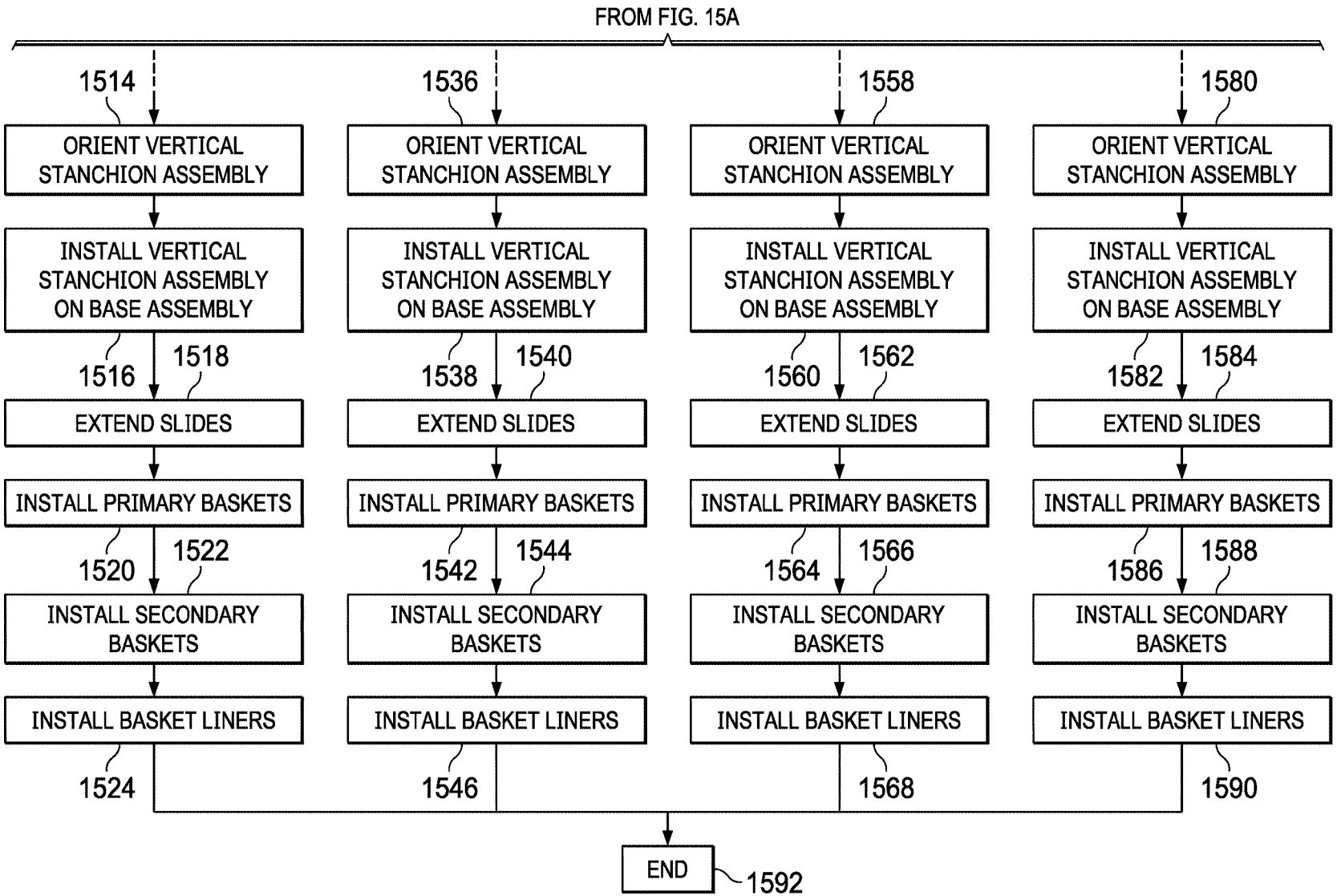

Referring to FIGS. 15A and 15B, preferred method 1500 of installation of the pullout mechanism into a blind corner cabinet, will be described.

At step 1501, a determination is made as to whether or not the blind corner cabinet has a left-hand orientation or a right-hand orientation.

If a left-hand orientation, then the method moves to step 1502. If a right-hand orientation, then the method moves to step 1503.

At step 1502, a determination is made as to whether or not the cabinet has a face frame.

If a face frame is present, then the method moves to step 1504. If not, then the method moves to step 1526.

At step 1504, the base assembly is oriented to the cabinet. The door opening cross bar is positioned adjacent the door side wall.

At step 1506, the orientation bracket and stabilizer are oriented. The extensions of the orientation bracket are positioned to extend past the door opening cross bar.

At step 1508, the orientation bracket and stabilizer are installed on the base assembly. Shoulder bolts are threaded into holes 354, 367, 374, and 350. The t-slots of the orientation bracket slide over the shoulder bolts in holes 354 and 367. The t-slots of the stabilizer slide over the shoulder bolts in holes 374 and 350. Shoulder bolts are tightened.

At step 1510, the base assembly is oriented inside the cabinet. The extensions of the orientation bracket fit into the corner of the face frame adjacent the door side wall. Side face 412 of the orientation bracket abuts the face frame. Side face 424 of the stabilizer abuts the front wall.

At step 1512, the base assembly is installed in the cabinet. Wood screws are threaded into the cabinet floor through holes 338 of the base assembly.

At step 1514, the vertical stanchion assembly is oriented. The slides extend out the door opening and away from the back wall. The slides are oriented consistent with the left-hand vertical slide arrangement, as previously described.

At step 1516, the vertical stanchion assembly is installed on the base assembly. Machine screws connect hole 1402 to vertical stanchion support hole 310, hole 1404 to vertical stanchion support hole 312, hole 976 to vertical stanchion support hole 314, hole 974 to vertical stanchion support hole 316, hole 1406 to vertical stanchion support hole 347, hole 1408 to vertical stanchion support hole 346, hole 982 to vertical stanchion support hole 349, and hole 980 to vertical stanchion support hole 344.

At step 1518, the slides are extended out of the door opening of the cabinet. The guide rollers engage the guide slots to provide stability to the right and left vertical support sub-assemblies.

At step 1520, the primary baskets are removably installed on the left vertical support subassembly. Holes for the hooks are determined based on the desired distance between the two primary baskets.

At step 1522, the secondary baskets are removably installed on the right vertical support subassembly. Holes for the hooks are determined based on the desired distance between the two secondary baskets.

At step 1524, liners are removably installed in the primary and secondary baskets.

At step 1592, installation is complete.

If the cabinet is determined at step 1502 to have no face frame, then at step 1526 the base assembly is oriented to the cabinet. The door opening cross bar is oriented adjacent the door side wall.

At step 1528, the orientation bracket and stabilizer are oriented to the base assembly. The extensions are positioned to extend away from the door opening cross bar.

At step 1530, the orientation bracket and stabilizer are installed on the base assembly. Shoulder bolts are threaded into holes 354, 367, 374, and 350. The t-slots of the orientation bracket are slid over the shoulder bolts in holes 354 and 367. The t-slots of the stabilizer are slid over the shoulder bolts in holes 374 and 350. The shoulder bolts are tightened.

At step 1532, the base assembly is oriented in the cabinet. The extensions of the orientation bracket are positioned adjacent the stabilizer. Side face 442 is aligned with the edge of the cabinet floor. Side face 434 of the stabilizer abuts the front wall.

At step 1534, the base assembly is installed in the cabinet. Wood screws are screwed into the cabinet floor through holes 338 of the base assembly.

At step 1536, the vertical stanchion assembly is oriented with respect to the cabinet. The slides extend out the door opening. The slides are oriented consistent with the left hand vertical slide arrangement, as previously described.

At step 1538, the vertical stanchion assembly is installed on the base assembly. Machine screws connect hole 1402 with vertical stanchion support hole 310, hole 1404 to vertical stanchion support hole 312, hole 976 to vertical stanchion support hole 314, hole 974 to vertical stanchion support hole 316, hole 1406 to vertical stanchion support hole 347, hole 1408 to vertical stanchion support hole 346, hole 982 to vertical stanchion support hole 349, and hole 980 to vertical stanchion support hole 344.

At step 1540, the slides are extended out the door opening. The guide rollers engage the guide slots. At step 1542, the primary baskets are installed on the left vertical support subassembly. The holes for the hooks to are determined based on the desired distance between the two primary baskets.

At step 1544, the secondary baskets are installed on the right vertical support subassembly. The holes for the hooks are determined based on the desired distance between the two secondary baskets.

At step 1546, the liners are installed in the primary and secondary baskets.

At step 1592, installation is complete.

If at step 1501, it was determined that the cabinet has a right-hand blind orientation, then at step 1503, then a determination is made whether or not the cabinet includes a face frame.

If it was determined that the cabinet does have a face frame, then at step 1548 the base assembly is oriented to the cabinet.

At step 1550, the orientation bracket and stabilizer are oriented with the base assembly. The extension of the orientation bracket extends adjacent the door opening cross bar.

At step 1552, the orientation bracket and stabilizer are installed on the base assembly. Shoulder bolts are threaded into holes 614, 616, 610, and 604. The t-slots of the orientation bracket slide over the shoulder bolts in holes 610 and 604. The t-slots of the stabilizer slide over the shoulder bolts in holes 614 and 616. Shoulder bolts are tightened.

At step 1554, the base assembly is oriented inside the cabinet. The outside extension of the orientation bracket fit into the corner of the face frame and the door side wall. Side face 442 of the orientation bracket abuts the face frame. Side face 434 of the stabilizer abuts the front wall.

At step 1556, the base assembly is installed in the cabinet. Wood screws are threaded into the cabinet floor through holes 338 of the base assembly.

At step 1558, the vertical stanchion assembly is oriented. The slides extend out the door opening. The slides are oriented consistent with the right-hand vertical slide arrangement, as previously described.

At step 1560, the vertical stanchion assembly is installed on the base assembly. Machine screws connect hole 1402 with vertical stanchion support hole 344, hole 1404 to vertical stanchion support hole 349, hole 976 to vertical stanchion support hole 346, hole 974 to vertical stanchion support hole 347, hole 1406 to vertical stanchion support hole 316, hole 1408 to vertical stanchion support hole 314, hole 982 to vertical stanchion support hole 312, and hole 980 to vertical stanchion support hole 310.

At step 1562, the slides are extended out the door opening. The guide rollers engage the guide slots. At step 1564, the primary baskets are installed the right vertical support subassembly. Holes for the hooks are determined based on the desired distance between the two primary baskets.

At step 1566, the secondary baskets are installed on the left vertical support subassembly. Holes for the hooks to install the secondary baskets are determined based on the desired distance between the two secondary baskets.

At step 1568, the liners are installed in the primary and secondary baskets.

At step 1592, installation is complete.

If the cabinet was determined to be a right oriented blind cabinet with a no face frame, then at step 1570 the base assembly is oriented to the cabinet.

At step 1572, the orientation bracket and stabilizer are oriented with the base assembly. The extensions are positioned away from the door opening cross bar and toward the stabilizer.

At step 1574, the orientation bracket and stabilizer are installed on the base assembly. Shoulder bolts are threaded into holes 614, 616, 610, and 604. The t-slots of the orientation bracket slide over the shoulder bolts in holes 610 and 604. The t-slots of the stabilizer slide over the shoulder bolts in holes 614 and 616. Shoulder bolts are tightened.

At step 1576, the base assembly is oriented inside the cabinet. The door opening cross bar abuts the door side wall. Side face 412 of the orientation bracket abuts the edge of the cabinet floor. Side face 424 of the stabilizer abuts the front wall.

At step 1578, the base assembly is installed in the cabinet. Wood screws are threaded into the cabinet floor through holes 338 of the base assembly.

At step 1580, the vertical stanchion assembly is oriented. The slides extend out the door opening. The guide rollers engage the guide slots. The slides are oriented consistent with the right-hand vertical slide arrangement, as previously described.

At step 1582, the vertical stanchion assembly is installed on the base assembly. Machine screws connect hole 1402 with vertical stanchion support hole 344, hole 1404 to vertical stanchion support hole 349, hole 976 to vertical stanchion support hole 346, hole 974 to vertical stanchion support hole 347, hole 1406 to vertical stanchion support hole 316, hole 1408 to vertical stanchion support hole 314, hole 982 to vertical stanchion support hole 312, and hole 980 to vertical stanchion support hole 310.

At step 1584, the slides are extended out the door opening. At step 1586, the primary baskets are installed on the right vertical support subassembly. Holes for the hooks on the primary baskets are determined based on the desired distance between the primary baskets.

At step 1588, the secondary baskets are installed on the left vertical support subassembly. Holes for the hooks on the secondary baskets are determined based on the desired distance between the two secondary baskets.

At step 1590, liners are installed in the primary and secondary baskets.

At step 1592, installation is complete.

Figure 16:
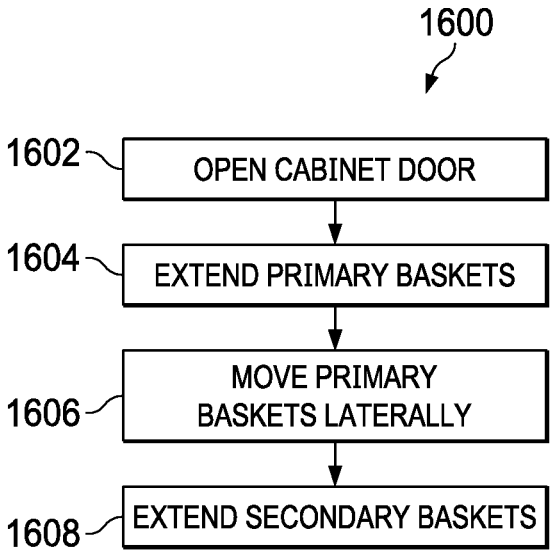
FIG. 16 is a flowchart for use of a preferred embodiment.

Referring to FIG. 16, preferred method 1600 of extending the pullout mechanism will be described.

At step 1602, the cabinet door is opened. The hinges extend into the gap between the bracket and the stabilizer. The primary baskets are positioned behind the door opening.

At step 1604, the primary baskets are extended out of the door opening. If the cabinet has a face frame and a left-hand orientation, the rollers on the left vertical support subassembly will pass through the gap between the stabilizer and the orientation bracket. If the cabinet has a face frame and a right-hand orientation, the rollers on the right vertical support subassembly will pass through the gap between the stabilizer and the orientation bracket. If the cabinet has a left-hand orientation and no face frame, the rollers on the left vertical support subassembly will pass over the extensions on the orientation bracket. If the cabinet has a right-hand orientation and no face frame, the rollers on the right vertical support subassembly will pass over the extensions on the orientation bracket.

At step 1606, the primary baskets are moved laterally away from the door. The lateral movement slides the vertical support subassembly, which is attached to flanges 308 and 356, toward the door opening crossbar 336 of the base assembly. This lateral movement positions the secondary baskets within the cabinet carcass behind the door opening.

At step 1608, the secondary baskets are extended out of the cabinet door opening. If the cabinet has a left-hand orientation and a face frame, the rollers on the right vertical support subassembly will pass through guide slot 380 on the orientation bracket. If the cabinet has a right-hand orientation and a face frame, the rollers on the left vertical support subassembly will pass through guide slot 380 on the orientation bracket. If the cabinet has a left-hand orientation and no face frame, the rollers on the right vertical support subassembly will pass through guide slot 378 on the orientation bracket. If the cabinet has a right-hand orientation and no face frame, the rollers on the left vertical support subassembly will pass through guide slot 378 on the orientation bracket. The vertical stanchion assembly must be moved laterally until the slides of the base assembly abut the bumpers. If not, the rollers of the vertical support assembly will abut the orientation bracket when the vertical support assembly is extended which will prevent the secondary baskets from extending out of the cabinet. This is a safety feature to prevent potential damage to the cabinet or the apparatus from the secondary baskets connecting with the face frame or front wall because the secondary baskets do not clear the door opening of the cabinet.

To stow the pullout mechanism, steps 1602, 1604, 1606 and 1608 are reversed.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A reconfigurable mounting system and a blind corner cabinet, the blind corner cabinet having either a right hand configuration or a left hand configuration, and the blind corner cabinet further has either a face frame configuration or a no-face frame configuration, the mounting system comprising:

a base frame;

the base frame having a first base orientation for the right hand configuration and a second base orientation for the left hand configuration;

an orientation bracket, positioned adjacent the base frame and the blind corner cabinet;

a stabilizer bracket, positioned adjacent the orientation bracket and the base frame;

wherein the orientation bracket is positioned to the right of the stabilizer bracket in the right hand configuration;

wherein the orientation bracket is positioned to the left of the stabilizer bracket in the left hand configuration;

wherein the stabilizer bracket further comprises a longitudinal extension;

wherein the longitudinal extension is positioned adjacent the cabinet in the face frame configuration; and, wherein the longitudinal extension is positioned adjacent the stabilizer bracket in the no-face frame configuration.

2. The mounting system of claim 1 further comprising:

a set of longitudinal slides rigidly mounted on the base frame;

a set of flanges movably mounted on the set of longitudinal slides; and, a vertical support frame mounted to the set of flanges in one of a first position in the right hand configuration and a second position in the left hand configuration.

3. The mounting system of claim 2 further comprising:

a support brace, rigidly mounted to the set of flanges, adjacent the vertical support frame.

4. The mounting system of claim 2 further comprising:

a first set of latitudinal slides attached to the vertical support frame;

a second set of latitudinal slides attached to the vertical support frame; and, wherein the first set of latitudinal slides and the second set of latitudinal slides has one of a first arrangement in the right hand configuration and a second arrangement in the left hand configuration.

5. The mounting system of claim 4 wherein:

the first set of latitudinal slides is proximal to the second set of latitudinal slides in the first arrangement; and, the second set of latitudinal slides is proximal to the first set of latitudinal slides in the second arrangement.

6. The mounting system of claim 4 further comprising:

a stress relieving means, connecting the first set of latitudinal slides to the vertical support frame, for preventing deformation.

7. The mounting system of claim 4 further comprising:

a first set of basket support posts rigidly mounted to the first set of latitudinal slides; and, a second set of basket supports posts rigidly mounted to the second set of latitudinal slides.

8. The mounting system of claim 7 further comprising:

a set of primary baskets adjustably mounted to one of the first set of basket support posts in the right hand configuration and the second set of basket supports in the left hand configuration; and, a set of secondary baskets adjustably mounted to one of the second set of basket support posts in the right hand configuration and the first set of basket support posts in the left hand configuration.

9. The mounting system of claim 8 further comprising:

a set of basket liners in the set of primary baskets and the set of secondary baskets.

10. The mounting system of claim 4 further comprising:

a first set of rollers positioned on the first set of latitudinal slides;

a second set of rollers positioned on the second set of latitudinal slides;

a first channel and a second channel formed in the orientation bracket;

wherein the first set of rollers and the second set of rollers is positioned to pass through the first channel in the frame configuration; and, wherein the first set of rollers and the second set of rollers is positioned to pass through the second channel in the no-frame configuration.

11. A method of mounting a reconfigurable system in a blind corner cabinet, the blind corner cabinet having either a right hand configuration or a left hand configuration, wherein the blind corner cabinet has either a face frame configuration or a no-face frame configuration, the method comprising the steps of:

orienting a base frame in one of a first base orientation for the right hand configuration and a second base orientation for the left hand configuration;

positioning an orientation bracket adjacent the base frame and the blind corner cabinet;

positioning a stabilizer bracket adjacent the orientation bracket and adjacent the base frame;

wherein the orientation bracket is positioned to the right of the stabilizer bracket in the right hand position;

wherein the orientation bracket is positioned to the left of the stabilizer bracket in the left hand position;

positioning a longitudinal extension of the orientation bracket adjacent the cabinet in the face frame configuration; and, positioning the longitudinal extension of the orientation bracket adjacent the stabilizer in the no-face frame configuration.

12. The method of claim 11 further comprising:

providing a set of longitudinal slides on the base frame;

movably mounting a set of flanges on the set of longitudinal slides; and, mounting a vertical support frame to the set of flanges in one of a first position in the right hand configuration and a second position in the left hand configuration.

13. The method of claim 12 further comprising the steps of:

mounting a first set of latitudinal slides and a second set of latitudinal slides to the vertical support frame in one of a first arrangement in the right hand configuration and a second arrangement in the left hand configuration.

14. The method of claim 13 further comprising the steps of:

mounting a first set of basket support posts to the first set of latitudinal slides; and, mounting a second set of basket support posts to the second set of latitudinal slides.

15. The method of claim 14 further comprising the steps of:

mounting a primary set of baskets on the first set of basket support posts; and, mounting a secondary set of baskets on the second set of basket support posts.

16. The method of claim 13 further comprising:

providing a first channel and a second channel in the orientation bracket;

positioning a first set of rollers in the first set of slides;

positioning a second set of rollers on the second set of latitudinal slides;

moving the first set of rollers and the second set of rollers through the first channel in the frame configuration; and, moving the first set of rollers and the second set of rollers through the second channel in the no-frame configuration.

* * * * *